US009985371B1

(12) United States Patent
Ashibu et al.

(10) Patent No.: US 9,985,371 B1
(45) Date of Patent: May 29, 2018

(54) CONNECTOR

(71) Applicants: JAPAN AVIATION ELECTRONICS INDUSTRY, LIMITED, Shibuya-ku, Tokyo (JP); JAE ELECTRONICS, INC., Irvine, CA (US)

(72) Inventors: Kenta Ashibu, Tokyo (JP); Shuhei Yamaguchi, Tokyo (JP); Hiroaki Obikane, Tokyo (JP); Takayuki Nishimura, Tokyo (JP); Daisuke Machihara, Irvine, CA (US)

(73) Assignees: JAPAN AVIATION ELECTRONICS INDUSTRY, LIMITED, Tokyo (JP); JAE ELECTRONICS, INC., Irvine, CA (US)

( * ) Notice: Subject to any disclaimer, the term of this patent is extended or adjusted under 35 U.S.C. 154(b) by 0 days. days.

(21) Appl. No.: 15/683,152

(22) Filed: Aug. 22, 2017

Related U.S. Application Data

(60) Provisional application No. 62/484,108, filed on Apr. 11, 2017.

(51) Int. Cl.
*H01R 12/78* (2011.01)
*H01R 12/72* (2011.01)
(Continued)

(52) U.S. Cl.
CPC ..... *H01R 12/78* (2013.01); *H01R 12/7005* (2013.01); *H01R 12/725* (2013.01);
(Continued)

(58) Field of Classification Search
CPC ..... H01R 13/6275; H01R 23/725; H01R 13/6272; H01R 9/096
(Continued)

(56) References Cited

U.S. PATENT DOCUMENTS 6,398,577 B1 * 6/2002 Simmel ..... H01R 13/6275 439/341
7,128,581 B2 * 10/2006 Igarashi ..... H01R 12/716 439/74
(Continued)

FOREIGN PATENT DOCUMENTS

JP 2011065861 A 3/2011
JP 5716803 B2 5/2015

*Primary Examiner* — Gary Paumen
(74) *Attorney, Agent, or Firm* — Holtz, Holtz & Volek PC

(57) ABSTRACT

A connector is mountable on an object in an up-down direction and mateable with a mating connector along the up-down direction. The mating connector comprises four locked portions. The connector comprises two additional members. Each of the additional members comprises two regulation mechanisms. Each of the regulation mechanisms comprises a spring portion, an operation portion, a first regulating portion, and a second regulating portion. The spring portion has a lock portion. The operation portion has a first regulated portion. One of the spring portion and the operation portion is provided with a second regulated portion. An upward movement of the lock portion is regulated when the first regulated portion is moved upward in the up-down direction to abut against the first regulating portion. The second regulating portion is brought into contact with the second regulated portion to regulate an outward movement of the lock portion in the second direction when the lock portion receives an upward force under a state where the first regulated portion abuts against the first regulating portion.

16 Claims, 18 Drawing Sheets

(51) Int. Cl.

| | |
|---|---|
| ***H01R 13/639*** | (2006.01) |
| ***H01R 12/70*** | (2011.01) |
| ***H01R 13/635*** | (2006.01) |
| ***H01R 13/6581*** | (2011.01) |

(52) U.S. Cl.
CPC ..... *H01R 13/635* (2013.01); *H01R 13/639* (2013.01); *H01R 13/6581* (2013.01)

(58) Field of Classification Search
USPC ..... 439/358, 357, 74, 352
See application file for complete search history.

(56) References Cited

U.S. PATENT DOCUMENTS

| | | | | |
|---|---|---|---|---|
| 7,390,216 | B1 * | 6/2008 | Lee | H01R 12/714 439/541.5 |
| 8,292,635 | B2 * | 10/2012 | Little | H01R 12/7029 439/570 |
| 8,961,215 | B2 * | 2/2015 | Hasegawa | H01R 9/091 439/346 |
| 9,130,309 | B2 * | 9/2015 | Ozeki | H01R 13/633 |
| 2013/0300943 | A1 * | 11/2013 | Hirabayashi | H04N 21/4383 348/731 |
| 2014/0227899 | A1 * | 8/2014 | Tanaka | H01R 13/631 439/357 |
| 2014/0227910 | A1 * | 8/2014 | Tanaka | H01R 12/7052 439/626 |
| 2015/0064942 | A1 * | 3/2015 | Takemoto | H01R 12/7029 439/74 |
| 2015/0270641 | A1 * | 9/2015 | Omodachi | H01R 12/707 439/374 |

* cited by examiner

CONNECTOR

BACKGROUND OF THE INVENTION

This invention relates to a connector which is mountable on an object and which is mateable with a mating connector.

As shown in FIGS. 33 to 35, Patent Document 1 discloses a connector 800 which is mounted on an object 860 in an up-down direction (Z-direction) and which is mateable with a mating connector 900 along the up-down direction (Z-direction). The mating connector 900 comprises a received portion 910 and locked portions 920. Under a mated state where the connector 800 is mated with the mating connector 900, each of the locked portions 920 faces upward (a positive Z-orientation) in the up-down direction. The connector 800 comprises a housing 810, a plurality of terminals 820 and two additional members 830. Each of the terminals 820 is held by the housing 810. Each of the additional members 830 is held by the housing 810. The housing 810 is formed with a receiving portion 812. Under the mated state where the connector 800 is mated with the mating connector 900, the receiving portion 812 receives the received portion 910. The two additional members 830 are positioned at opposite sides, respectively, of the housing 810 in a perpendicular direction (X-direction) perpendicular to the up-down direction. Each of the additional members 830 comprises a spring portion 840 and an operation portion 850. The spring portion 840 is resiliently deformable and has a lock portion 842. The lock portion 842 faces downward (a negative Z-orientation) in the up-down direction. The operation portion 850 extends outward in the perpendicular direction from the spring portion 840. The operation portion 850 has a pressed portion 852. The pressed portion 852 is positioned outward in the perpendicular direction beyond the receiving portion 812.

[Patent Document 1] JP-B 5716803

As understood from FIG. 35, in order to release the mated state of the connector 800 with the mating connector 900 of Patent Document 1, a jig 950 abuts against the pressed portion 852 of the operation portion 850 to apply a force thereto, so that the lock portion 842 is moved inward in the perpendicular direction to release the mating. Specifically, the lock portion 842 is supported by the spring portion 840 which is resiliently deformable, so that the lock portion 842 is movable in the perpendicular direction. However, there is a possibility that, if the mating connector 900 is pulled upward in order to be tried to be forcibly pulled off from the connector 800 under the mated state where the connector 800 is mated with the mating connector 900, the mating connector 900 might be pulled off from the connector 800 by the lock portion 842 being moved to cause a deformation of the spring portion 840.

SUMMARY OF THE INVENTION

It is therefore an object of the present invention to provide a connector having a structure which prevents a mating connector from being forcibly pulled off from the connector while enabling a lock therebetween to be released by using a jig.

One aspect of the present invention provides a connector mountable on an object in an up-down direction and mateable with a mating connector along the up-down direction. The mating connector comprises a received portion and four locked portions. Each of the locked portions is provided on the received portion. Under a mated state where the connector is mated with the mating connector, each of the locked portions faces upward in the up-down direction. The connector comprises a housing, a plurality of terminals and two additional members. Each of the terminals is held by the housing. Each of the additional members is held by the housing. The housing is formed with a receiving portion. Under the mated state, the receiving portion receives the received portion. The two additional members are positioned at opposite ends, respectively, of the housing in a first direction perpendicular to the up-down direction. Each of the additional members comprises two regulation mechanisms. In each of the additional members, the two regulation mechanisms are positioned away from each other in a second direction perpendicular to both the up-down direction and the first direction. Each of the regulation mechanisms comprises a spring portion, an operation portion, a first regulating portion, and a second regulating portion. In each of the regulation mechanisms, the spring portion is resiliently deformable and has a lock portion. In each of the regulation mechanisms, the lock portion is positioned in the receiving portion and faces downward in the up-down direction. The lock portions correspond to the locked portions, respectively. Under the mated state, each of the locked portions at least overlaps with the lock portion corresponding to the locked portion in the up-down direction. In each of the regulation mechanisms, the operation portion extends outward in the first direction from the spring portion. In each of the regulation mechanisms, the operation portion has a pressed portion and a first regulated portion. In each of the regulation mechanisms, the pressed portion is positioned outward in the first direction beyond the receiving portion. In each of the regulation mechanisms, one of the spring portion and the operation portion is provided with a second regulated portion. In each of the regulation mechanisms, the lock portion is moved outward in the second direction when the pressed portion is moved outward in the second direction. In each of the regulation mechanisms, the first regulated portion is positioned between the lock portion and the pressed portion in the first direction. In each of the regulation mechanisms, the first regulating portion is positioned above the first regulated portion in the up-down direction. In each of the regulation mechanisms, an upward movement of the lock portion is regulated when the first regulated portion is moved upward in the up-down direction to abut against the first regulating portion. In each of the regulation mechanisms, the second regulating portion is brought into contact with the second regulated portion to regulate an outward movement of the lock portion in the second direction when the lock portion receives an upward force under a state where the first regulated portion abuts against the first regulating portion.

Under the mated state where the connector of the present invention is mated with the mating connector, the locked portion at least overlaps with the lock portion in the up-down direction. The upward movement of the lock portion is regulated by the first regulated portion abutting against the first regulating portion if the mating connector is tried to be forcibly pulled off from the connector under the mated state, and the second regulating portion is brought into contact with the second regulated portion to regulate the outward movement of the lock portion in the second direction when the lock portion receives the upward force under the state where the first regulated portion abuts against the first regulating portion. As a result, the aforementioned state where the locked portion at least overlaps with the lock portion in the up-down direction is maintained, so that the mating connector is prevented from being forcibly pulled off from the connector.

An appreciation of the objectives of the present invention and a more complete understanding of its structure may be had by studying the following description of the preferred embodiment and by referring to the accompanying drawings.

Figure 1:
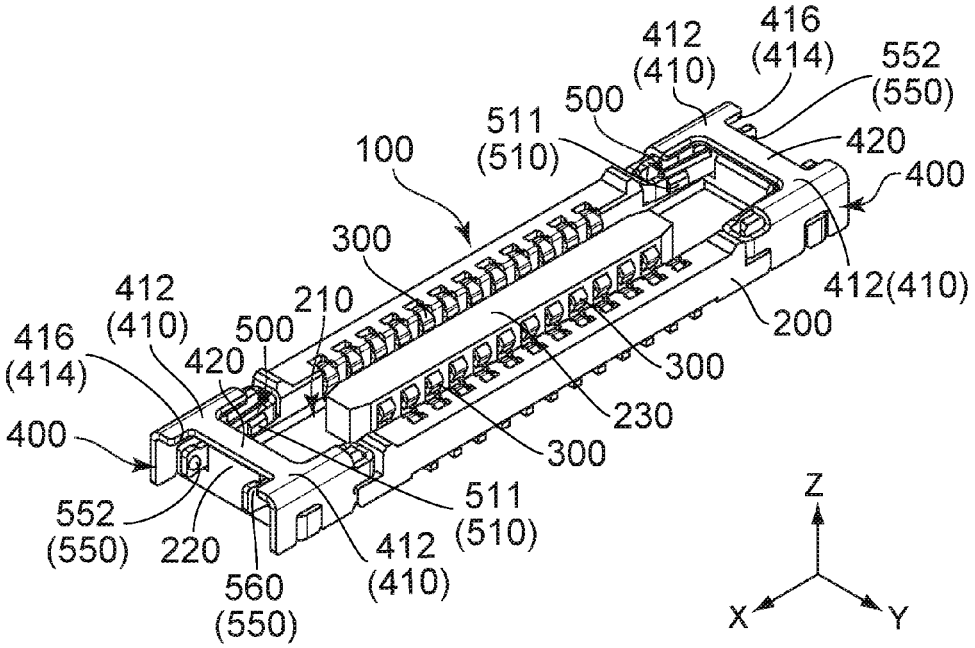
FIG. 1 is an upper perspective view showing a connector according to a first embodiment of the present invention.
Figure 2:
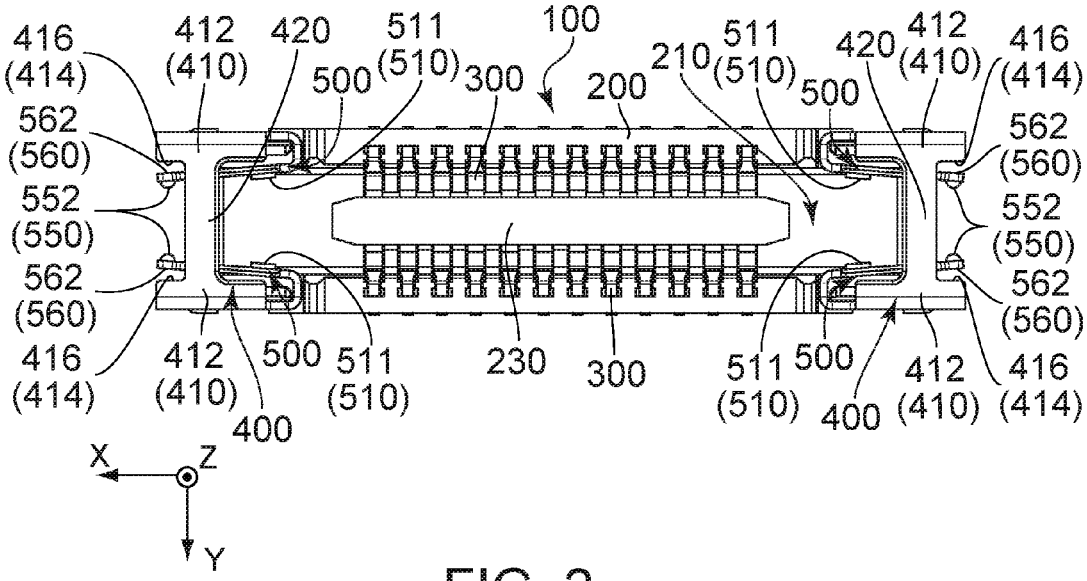
FIG. 2 is a top view showing the connector of FIG. 1.
Figure 3:
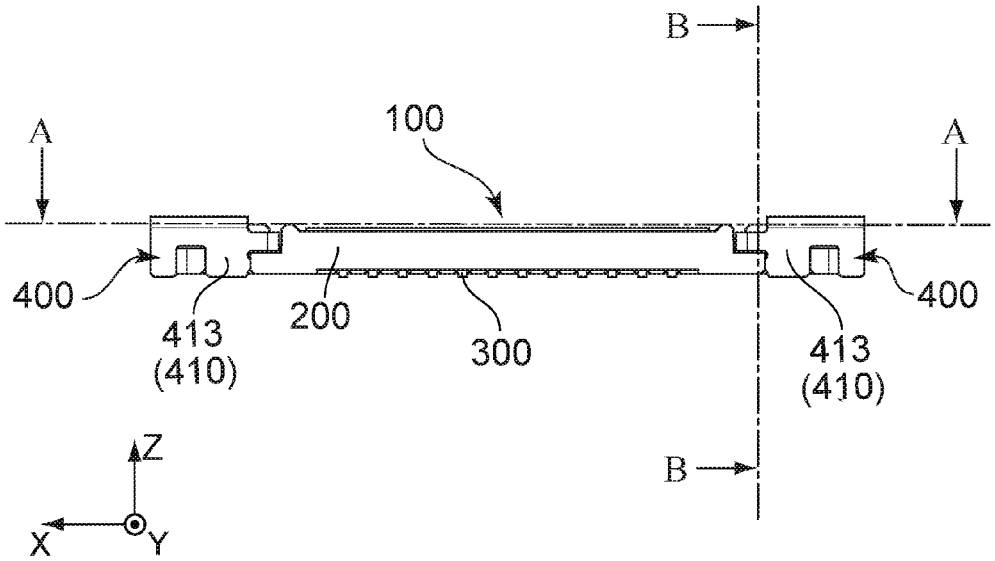
FIG. 3 is a side view showing the connector of FIG. 1.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Referring to FIGS. 1, 12, 16 and 17, a connector 100 according to a first embodiment of the present invention is mountable on an object (not shown) in an up-down direction, and is mateable with a mating connector 700 along the up-down direction. In the present embodiment, the up-down direction is a Z-direction. In addition, in the present embodiment, it is assumed that upward is a positive Z-direction while downward is a negative Z-direction.

Referring to FIGS. 12 to 15, the mating connector 700 of the present embodiment comprises a received portion 710 and four locked portions 722.

As shown in FIGS. 12 to 15, the received portion 710 of the present embodiment has a mating housing 705, two power terminals 715 and a plurality of mating terminals 730.

As shown in FIGS. 12 to 15, the mating housing 705 has a substantially cuboid shape extending in a first direction perpendicular to the up-down direction. In the present embodiment, the first direction is an X-direction. The mating housing 705 has an island-like portion accommodating portion 740. The island-like portion accommodating portion 740 is recessed upward in the up-down direction, and has a bottom surface 742 facing downward. Specifically, the mating housing 705 is made of insulator.

As shown in FIGS. 12 to 15, the two power terminals 715 are positioned at opposite ends, respectively, of the mating housing 705 in the first direction. Specifically, each of the power terminals 715 is made of metal. Each of the power terminals 715 comprises two recesses 720 and two corner portions 718 in a second direction perpendicular to both the up-down direction and the first direction. In other words, the mating connector 700 comprises four of the recesses 720 and four of the corner portions 718. In the present embodiment, the second direction is a Y-direction. Each of the recesses 720 is recessed inward in the second direction, and has a side surface 724 which is perpendicular to the second direction. Each of the recesses 720 has a lower surface 722 in the up-down direction. The lower surface 722 is a plane perpendicular to the up-down direction. The lower surface 722 of each of the recesses 720 functions as the locked portion 722. In other words, each of the locked portions 722 is provided on the received portion 710. The corner portions 718 correspond to the recesses 720, respectively. Each of the corner portions 718 is positioned below the recess 720 corresponding to the corner portion 718 in the up-down direction.

Referring to FIGS. 12 to 15, each of the mating terminals 730 is made of conductor and is held by the mating housing 705.

As shown in FIGS. 1 to 4, the connector 100 of the present embodiment comprises a housing 200, a plurality of terminals 300 and two additional members 400.

As shown in FIGS. 1 to 4, the housing 200 of the present embodiment extends in the first direction. The housing 200 is made of insulator. The housing 200 is formed with a receiving portion 210 and an island-like portion 230. The receiving portion 210 is recessed downward in the up-down direction. The island-like portion 230 is positioned inside the receiving portion 210 in a plane perpendicular to the up-down direction. In the present embodiment, the plane perpendicular to the up-down direction is an XY-plane. The island-like portion 230 protrudes upward in the up-down direction. The housing 200 has two deformation-preventing portions 220 which correspond to the two additional members 400, respectively.

Figure 4:
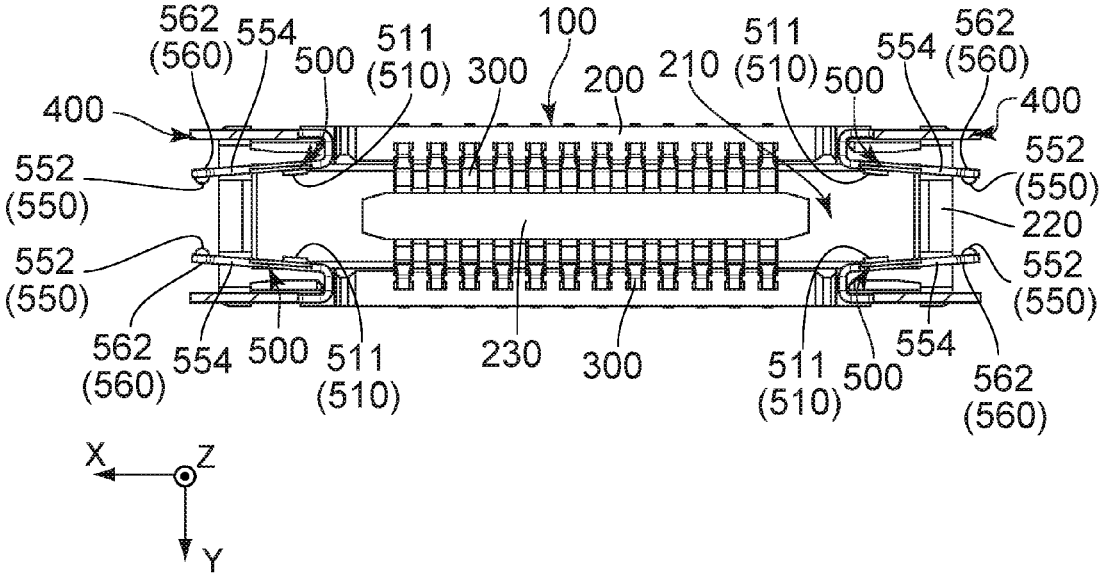
FIG. 4 is a cross-sectional view showing the connector of FIG. 3, taken along line A-A.
Figure 14:
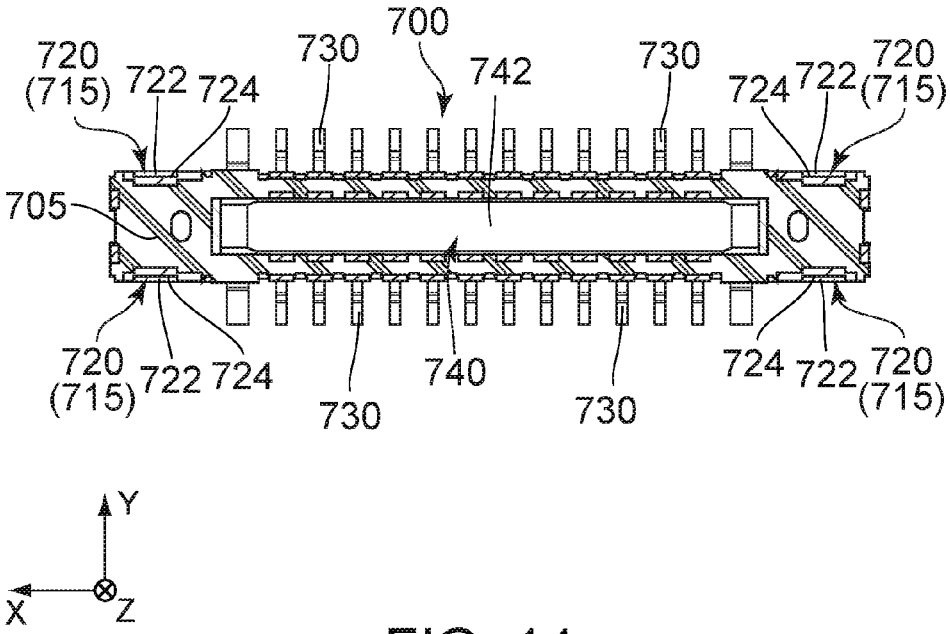
FIG. 14 is a cross-sectional view showing the mating connector of FIG. 13, taken along line C-C.
Figure 15:
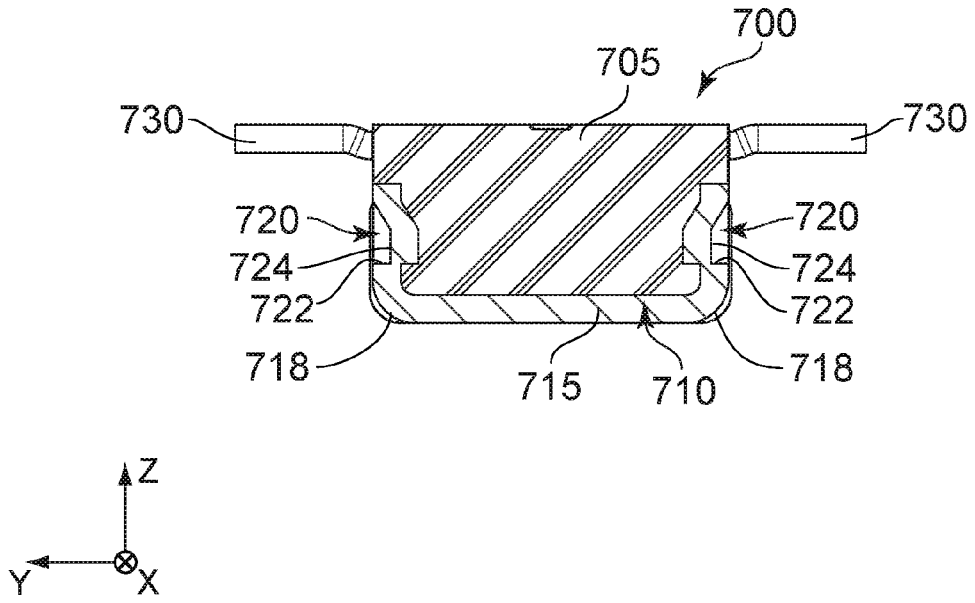
FIG. 15 is a cross-sectional view showing the mating connector of FIG. 13, taken along line D-D.
Figure 16:
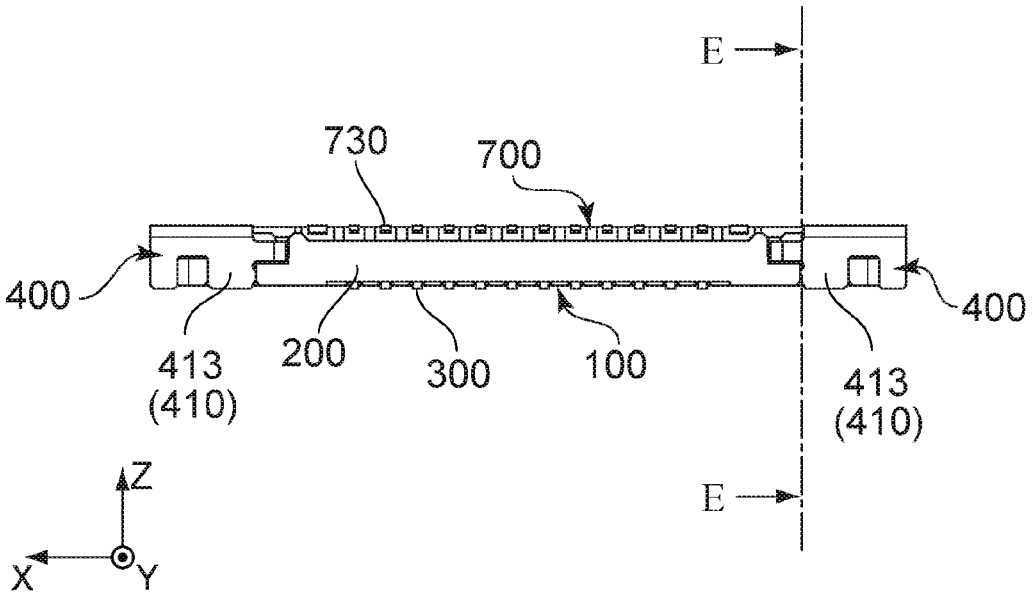
FIG. 16 is a side view showing a mated state where the connector of FIG. 1 is mated with the mating connector of FIG. 12.

As shown in FIGS. 1 to 4, each of the terminals 300 of the present embodiment is held by the housing 200. Each of the terminals 300 is made of conductor. Referring to FIGS. 4, 14 and 16, as described later, the terminals 300 of the connector 100 are connected with the mating terminals 730, respectively, of the mating connector 700 under a mated state where the connector 100 is mated with the mating connector 700.

As shown in FIGS. 1 to 5, each of the additional members 400 of the present embodiment is held by the housing 200. More specifically, the two additional members 400 are positioned at opposite ends, respectively, of the housing 200 in the first direction. Each of the additional members 400 faces the island-like portion 230 of the housing 200 in the first direction. Each of the additional members 400 of the present embodiment is made of metal.

As shown in FIGS. 1, 2 and 4 to 11, the additional member 400 has a symmetrical structure with respect to a plane, wherein the plane is defined by the first direction and the up-down direction while passing through a middle of the additional member 400 in the second direction. In the present embodiment, the plane defined by the first direction and the up-down direction is an XZ-plane.

As shown in FIGS. 6 to 11, each of the additional members 400 of the present embodiment comprises two regulation mechanisms 500. In each of the additional members 400, the two regulation mechanisms 500 are positioned away from each other in the second direction. The two regulation mechanisms 500 are arranged so as to be mirror-symmetric with each other to a plane, wherein the plane is defined by the first direction and the up-down direction while passing through the middle of the additional member 400 in the second direction. Each of the two regulation mechanisms 500 is independently movable. Each of the regulation mechanisms 500 comprises a spring portion 510, an operation portion 550, a first regulating portion 580 and a second regulating portion 416.

As shown in FIGS. 6 to 11, in each of the regulation mechanisms 500, the spring portion 510 of the present embodiment has a U-shape or a J-shape in a plane perpendicular to the up-down direction. The spring portion 510 is resiliently deformable. The spring portion 510 of the present embodiment has a bent portion 517, a flat plate portion 518 and a protrusion 511.

As shown in FIGS. 6 to 11, the bent portion 517 has a C-shape when viewed along the up-down direction. The flat plate portion 518 has a plate-like shape extending substantially in the first direction. A size of the flat plate portion 518 in the second direction is smaller than a size of the flat plate portion 518 in the up-down direction.

As shown in FIGS. 6 to 11, the protrusion 511 protrudes inward in the second direction. More specifically, the protrusion 511 protrudes inward in the second direction from an inner surface of the flat plate portion 518 of the spring portion 510. The protrusion 511 has a lower surface 512 and a slope surface 514 in the up-down direction. The lower surface 512 faces downward in the up-down direction. More specifically, the lower surface 512 is a plane perpendicular to the up-down direction. The slope surface 514 intersects with both the up-down direction and the second direction. In addition, the protrusion 511 has a side surface 516 intersecting with the second direction. The side surface 516 faces inward in the second direction. The side surface 516 is positioned between the slope surface 514 and the lower surface 512 in the up-down direction. The lower surface 512 of the protrusion 511 functions as a lock portion 512. In other words, the spring portion 510 has the lock portion 512. The lock portion 512 is positioned in the receiving portion 210 of the housing 200. The lock portion 512 faces downward in the up-down direction. The lock portions 512 correspond to the locked portions 722, respectively, of the mating connector 700.

As shown in FIGS. 6 to 11, in each of the regulation mechanisms 500, the operation portion 550 of the present embodiment has a plate portion 556, a bulge portion 551 and a protruding portion 560. In each of the regulation mechanisms 500, the operation portion 550 of the present embodiment extends outward in the first direction from the spring portion 510. More specifically, the plate portion 556 of the operation portion 550 of the present embodiment extends outward in the first direction from an outward end of the flat plate portion 518 of the spring portion 510. The bulge portion 551 is positioned in the vicinity of an outward end of the plate portion 556 in the first direction. A part of an upper end of the plate portion 556 in the up-down direction functions as a first regulated portion 554. An inner end of the bulge portion 551 in the second direction functions as a pressed portion 552. In other words, the operation portion 550 has the pressed portion 552 and the first regulated portion 554. The pressed portion 552 is positioned outward in the first direction beyond the receiving portion 210. In each of the regulation mechanisms 500, the lock portion 512 of the spring portion 510 is moved outward in the second direction when the pressed portion 552 is moved outward in the second direction. In each of the regulation mechanisms 500, the first regulated portion 554 is positioned between the lock portion 512 of the spring portion 510 and the pressed portion 552 in the first direction. The protruding portion 560 protrudes upward in the up-down direction. The protruding portion 560 has a side surface 562 in the second direction. The side surface 562 is an outer surface of the protruding portion 560 in the second direction. The side surface 562 of the protruding portion 560 functions as a second regulated portion 562. In other words, in each of the regulation mechanisms 500, the operation portion 550 is provided with the second regulated portion 562.

As shown in FIGS. 6 to 11, each of the additional members 400 of the present embodiment has two base portions 410 and a beam portion 420.

As shown in FIGS. 6 to 11, each of the base portions 410 of the present embodiment has an upper plate portion 412 and a side plate portion 413. The upper plate portion 412 has a plate-like shape intersecting with the up-down direction. The upper plate portion 412 has an edge 414 facing the second direction. The edge 414 is positioned in the vicinity of an outer end of the upper plate portion 412 in the first direction and is positioned at an inner end of the upper plate portion 412 in the second direction. The side plate portion 413 extends upward in the up-down direction. An upper end of the side plate portion 413 in the up-down direction is connected with an outer end of the upper plate portion 412 in the second direction. The two base portions 410 belong to the two regulation mechanisms 500, respectively. In each of the regulation mechanisms 500, the spring portion 510 extends from the base portion 410. More specifically, the bent portion 517 of the spring portion 510 extends from an inner end of the side plate portion 413 of the base portion 410 in the first direction. In each of the regulation mechanisms 500, the second regulating portion 416 is provided on the base portion 410. More specifically, in each of the regulation mechanisms 500, the second regulating portion 416 is provided on the edge 414 of the upper plate portion 412 of the base portion 410.

As shown in FIGS. 6 to 11, the beam portion 420 of the present embodiment has a plate-like shape intersecting with the up-down direction. More specifically, the beam portion 420 has a plate-like shape perpendicular to the up-down direction. Specifically, the beam portion 420 has an upper surface and a lower surface in the up-down direction. The beam portion 420 couples the two base portions 410 with each other in the second direction. More specifically, the beam portion 420 couples the upper plate portions 412 of the two base portions 410 with each other. The first regulating portion 580 of each of the regulation mechanisms 500 is formed as a part of the beam portion 420. More specifically, the first regulating portion 580 is a part of the lower surface of the beam portion 420.

Figure 5:
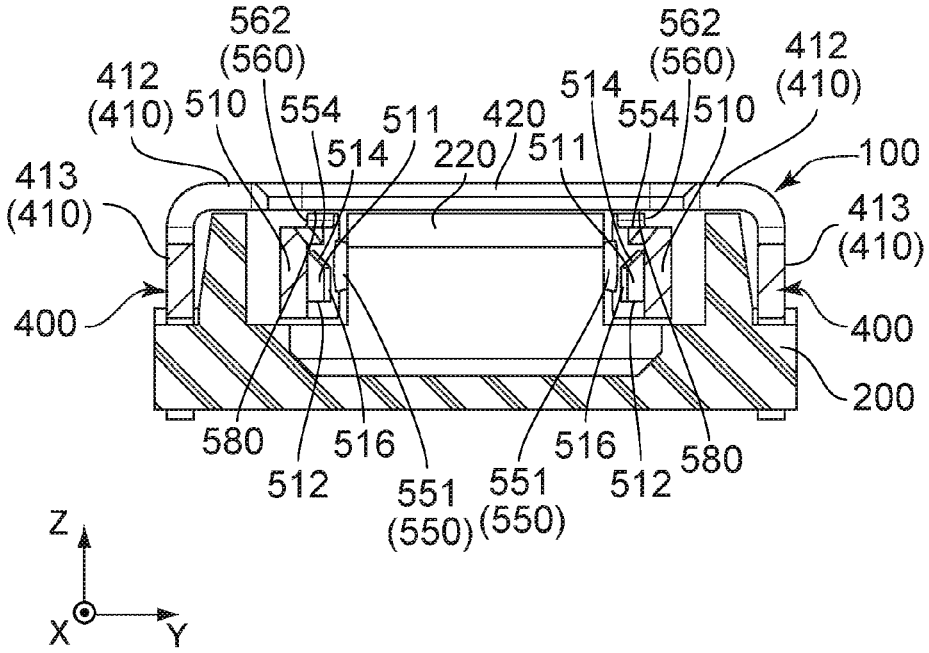
FIG. 5 is a cross-sectional view showing the connector of FIG. 3, taken along line B-B.
Figure 6:
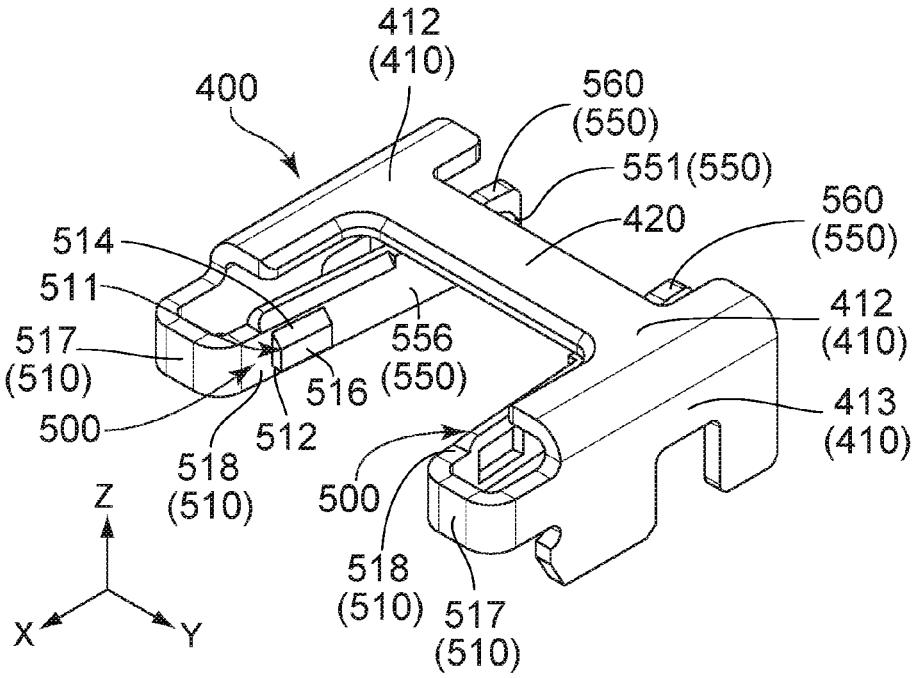
FIG. 6 is a front, perspective view showing one of additional members which are included in the connector of FIG. 1.
Figure 7:
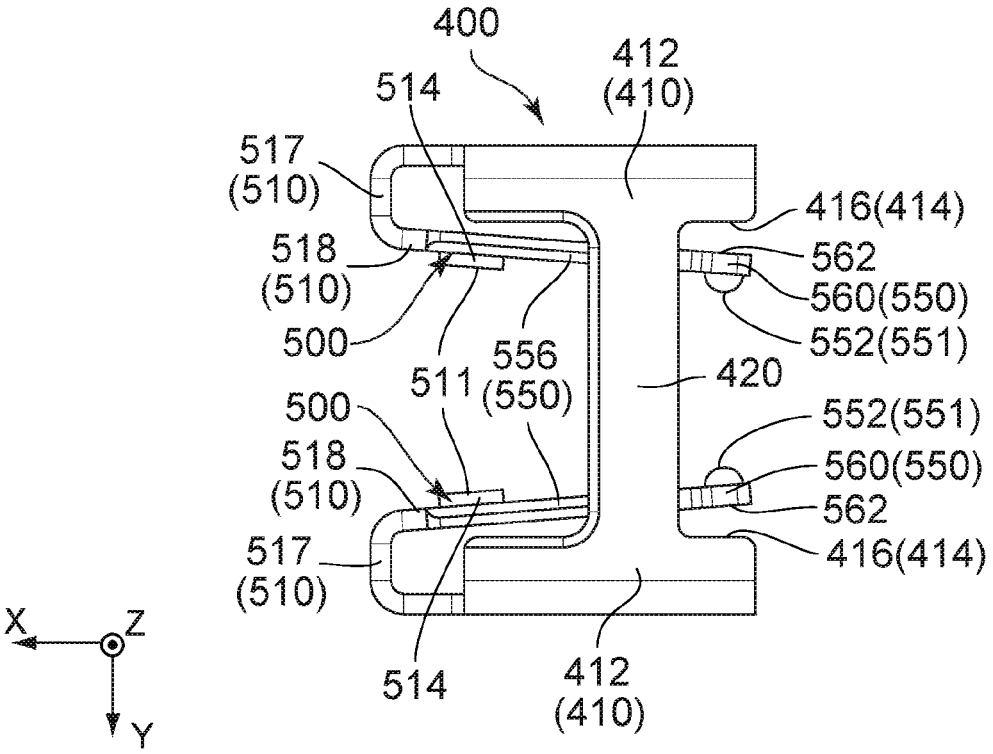
FIG. 7 is a top view showing the additional member of FIG. 6.
Figure 8:
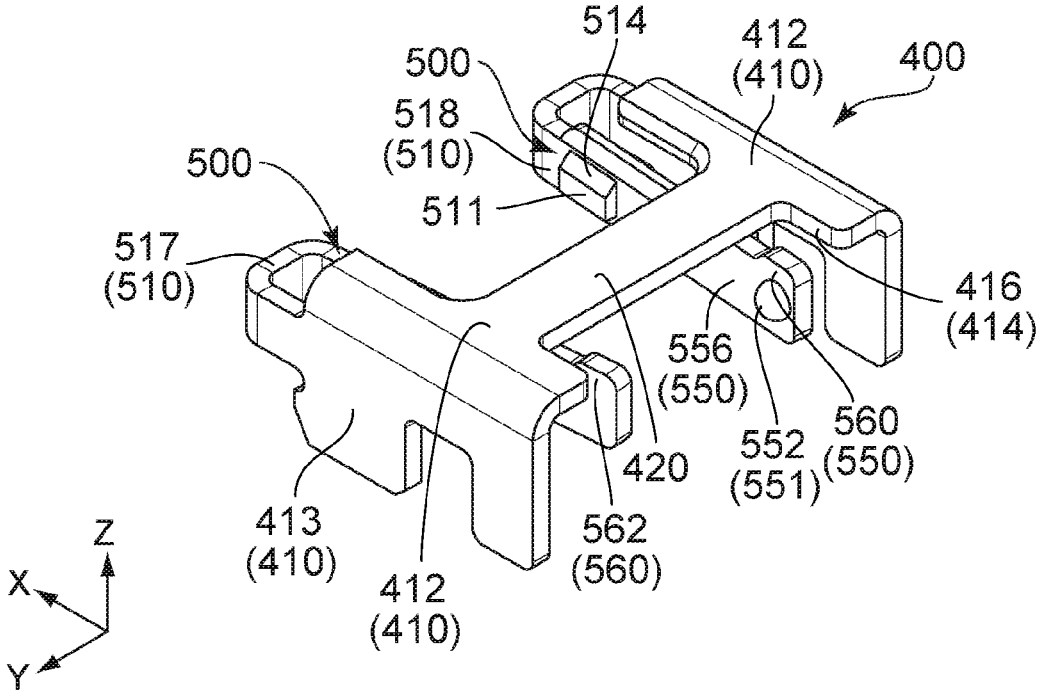
FIG. 8 is a rear, perspective view showing the additional member of FIG. 6.
Figure 9:
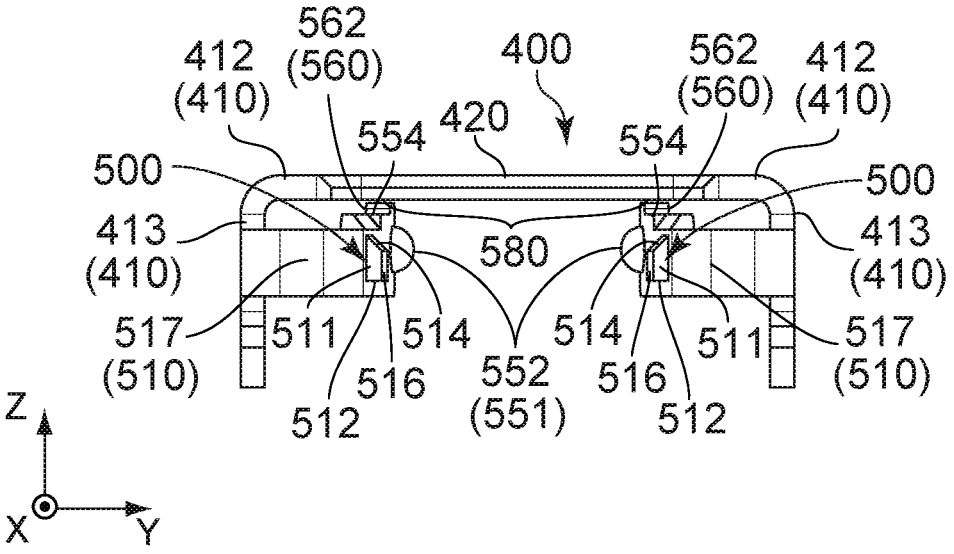
FIG. 9 is a front view showing the additional member of FIG. 6.
Figure 10:
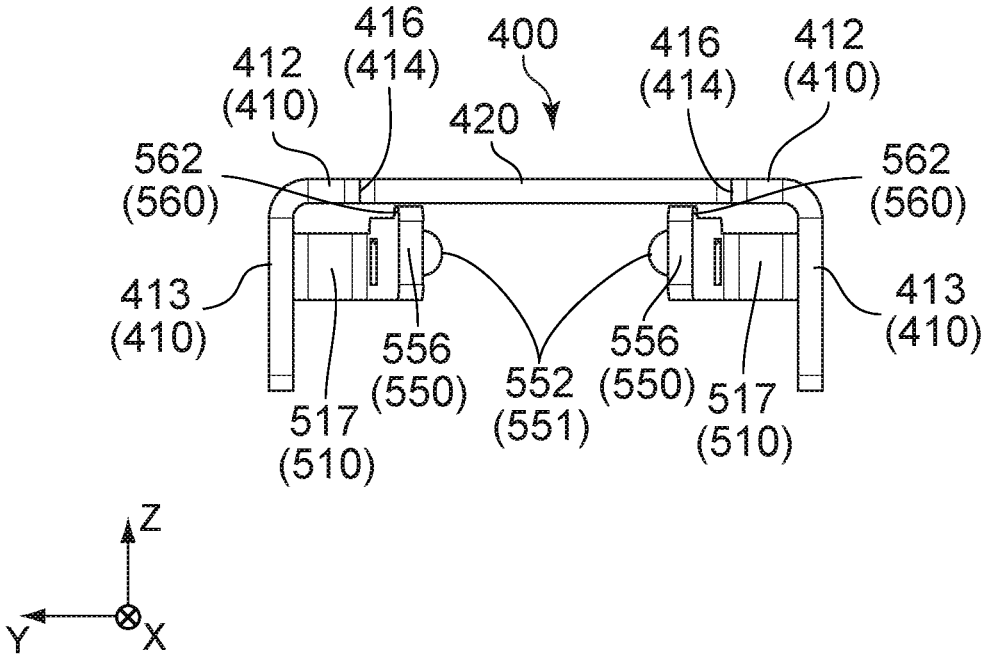
FIG. 10 is a rear view showing the additional member of FIG. 6.
Figure 11:
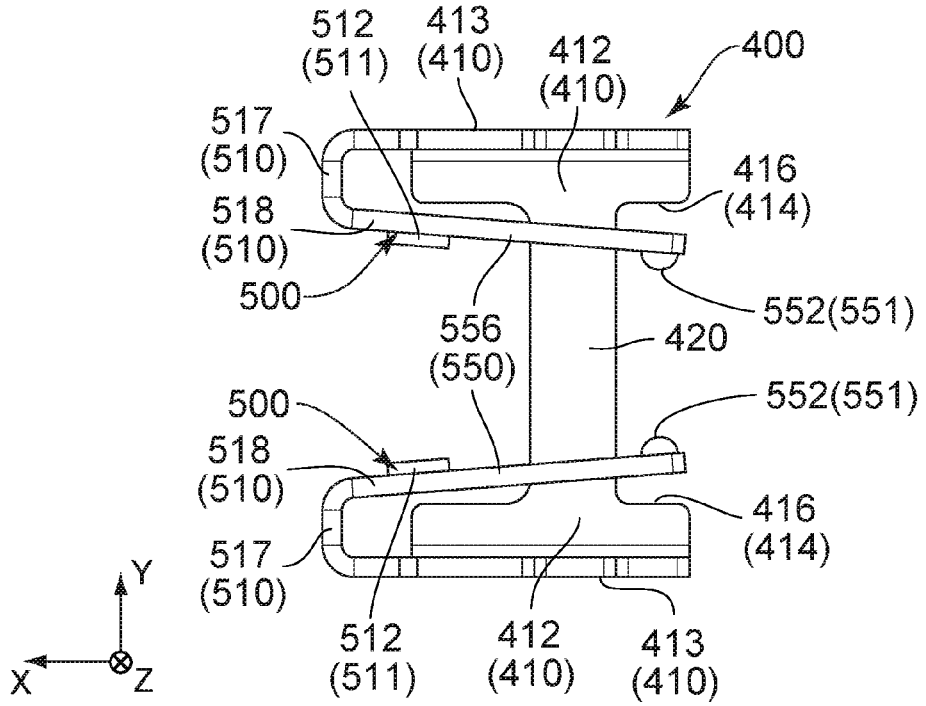
FIG. 11 is a bottom view showing the additional member of FIG. 6.
Figure 12:
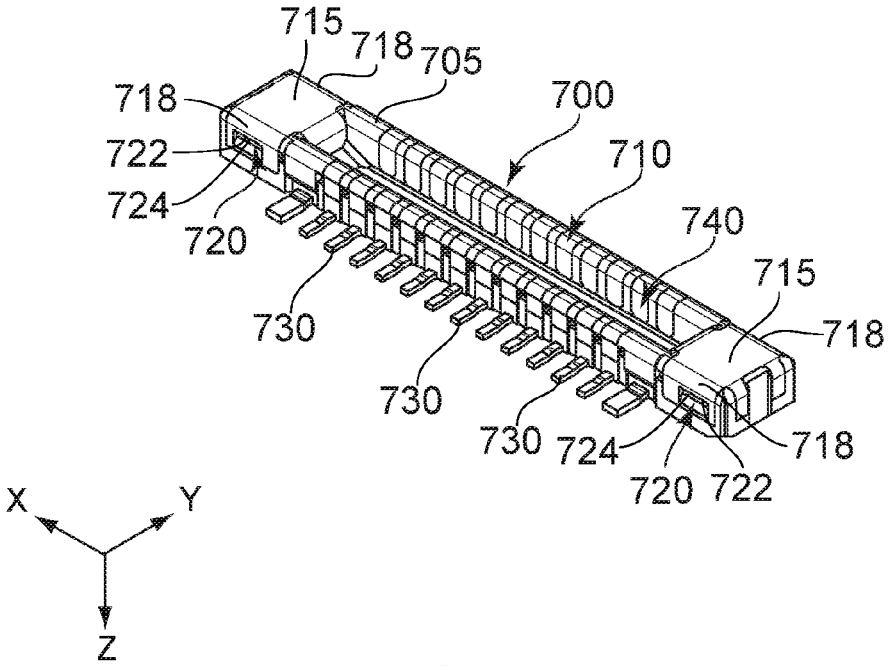
FIG. 12 is a lower perspective view showing a mating connector of the present invention.
Figure 13:
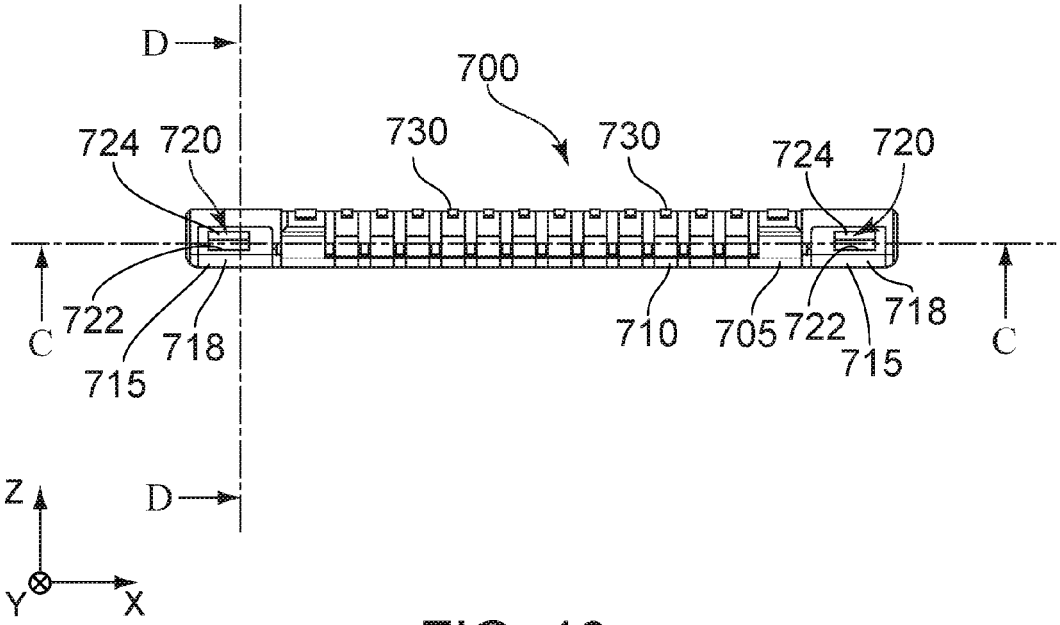
FIG. 13 is a side view showing the mating connector of FIG. 12.

As shown in FIGS. 5 and 9, in each of the regulation mechanisms 500, the first regulating portion 580 is positioned above the first regulated portion 554 in the up-down direction.

As shown in FIG. 5, in the up-down direction, each of the deformation-preventing portions 220 is positioned below the beam portion 420 of the additional member 400 corresponding thereto. The deformation-preventing portion 220 is a portion which prevents a deformation of the beam portion 420 by being brought into contact with the beam portion 420 when the beam portion 420 of the additional member 400 is pressed downward in the up-down direction. More specifically, an upper surface of the deformation-preventing portion 220 prevents a deformation of the beam portion 420 by being brought into contact with the lower surface of the beam portion 420 when the upper surface of the beam portion 420 is pressed downward.

As understood from FIGS. 5 and 8 to 11, in each of the regulation mechanisms 500, the second regulating portion 416 is positioned outward of the first regulating portion 580 in the first direction. In each of the regulation mechanisms 500, the second regulated portion 562 is positioned at a position different from a position of the second regulating portion 416 in the up-down direction when no upward force is applied to the lock portion 512. More specifically, in each of the regulation mechanisms 500, the second regulated portion 562 is positioned away from and below the second regulating portion 416 in the up-down direction when no upward force is applied to the lock portion 512.

An operation of mating the connector 100 with the mating connector 700 is described in detail hereinafter.

Referring to FIGS. 1, 12 and 16 to 19, the connector 100 and the mating connector 700 of the present embodiment are arranged so that the slope surfaces 514 of the protrusions 511 of the connector 100 face the corner portions 718, respectively, of the power terminals 715 of the mating connector 700 in the up-down direction, and the mating connector 700 is moved downward relative to the connector 100 along the up-down direction. Then, the slope surface 514 of each of the protrusions 511 of the connector 100 abuts against the corner portion 718 corresponding thereto of the power terminal 715 of the mating connector 700 and each of the spring portions 510 is resiliently deformed, so that each of the protrusions 511 is moved outward in the second direction. In this state, when the mating connector 700 is further moved downward relative to the connector 100 so that the lock portion 512 and the locked portion 722 corresponding thereto are positioned at the same position as each other in the up-down direction, the protrusions 511 of the connector 100 are accommodated in the recesses 720, respectively, of the mating connector 700. In other words, the connector 100 and the mating connector 700 are in a mated state where the connector 100 and the mating connector 700 are mated with each other.

Referring to FIGS. 1, 12, 16 and 17, under the mated state where the connector 100 and the mating connector 700 of the present embodiment are mated with each other, each of the locked portions 722 faces upward in the up-down direction while each of the locked portions 722 of the mating connector 700 at least overlaps with the lock portion 512 corresponding to the locked portion 722 in the up-down direction. In addition, under the mated state, the receiving portion 210 of the housing 200 of the connector 100 receives the received portion 710 of the mating connector 700 while the island-like portion 230 of the housing 200 of the connector 100 is accommodated in the island-like portion accommodating portion 740 of the mating housing 705 of the mating connector 700. Also, under the mated state, the terminals 300 of the connector 100 are connected with the mating terminals 730, respectively, of the mating connector 700. Furthermore, under the mated state, the side surfaces 724 of the recesses 720 of the power terminals 715 of the mating connector 700 are brought into contact with the side surfaces 516, respectively, of the protrusions 511 of the spring portions 510 of the additional members 400 of the connector 100, so that electrical connections are made between the power terminals 715 of the mating connector 700 and the additional members 400 of the connector 100.

An operation of releasing the mated state of the connector 100 with the mating connector 700 is described in detail hereinafter.

Figure 17:
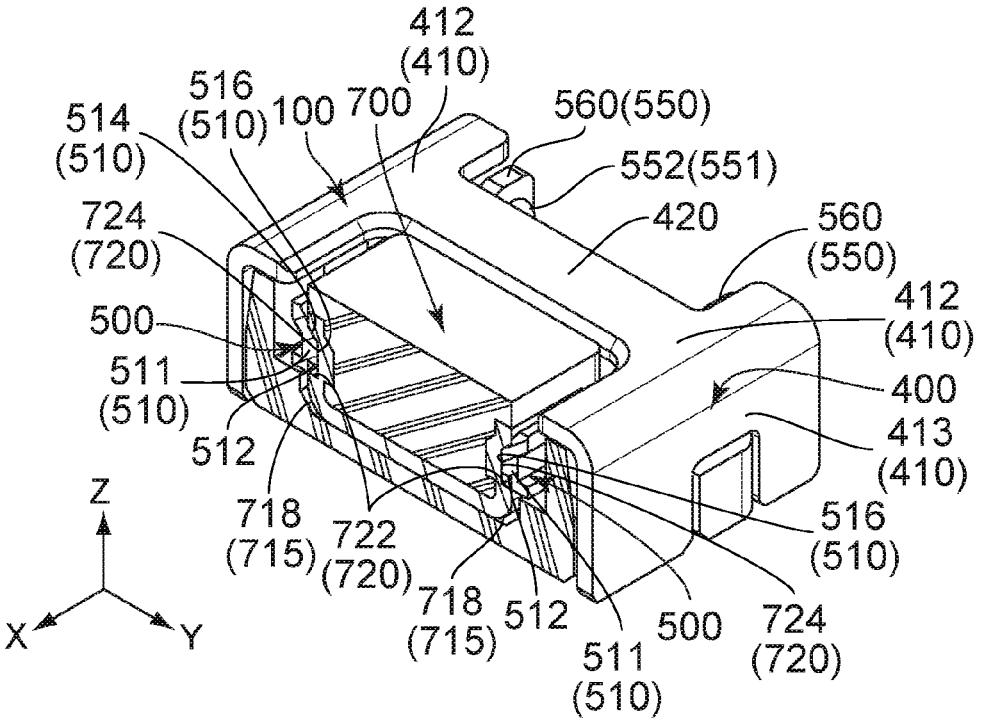
FIG. 17 is a cross-sectional, perspective view showing the connector and the mating connector of FIG. 16, taken along line E-E.
Figure 18:
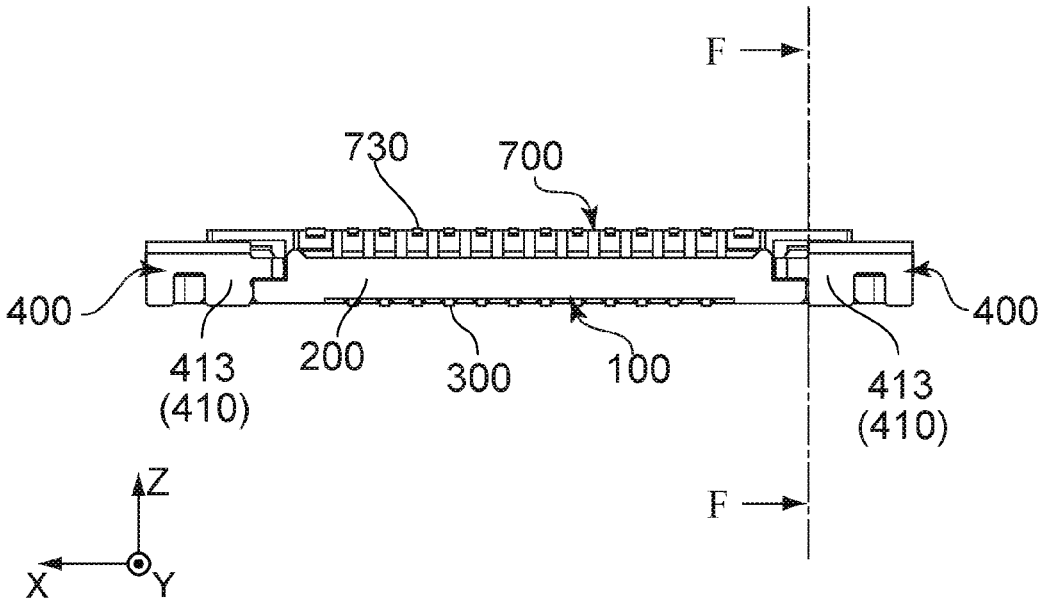
FIG. 18 is a side view showing a state where the mating of the connector of FIG. 1 with the mating connector of FIG. 12 is released.
Figure 19:
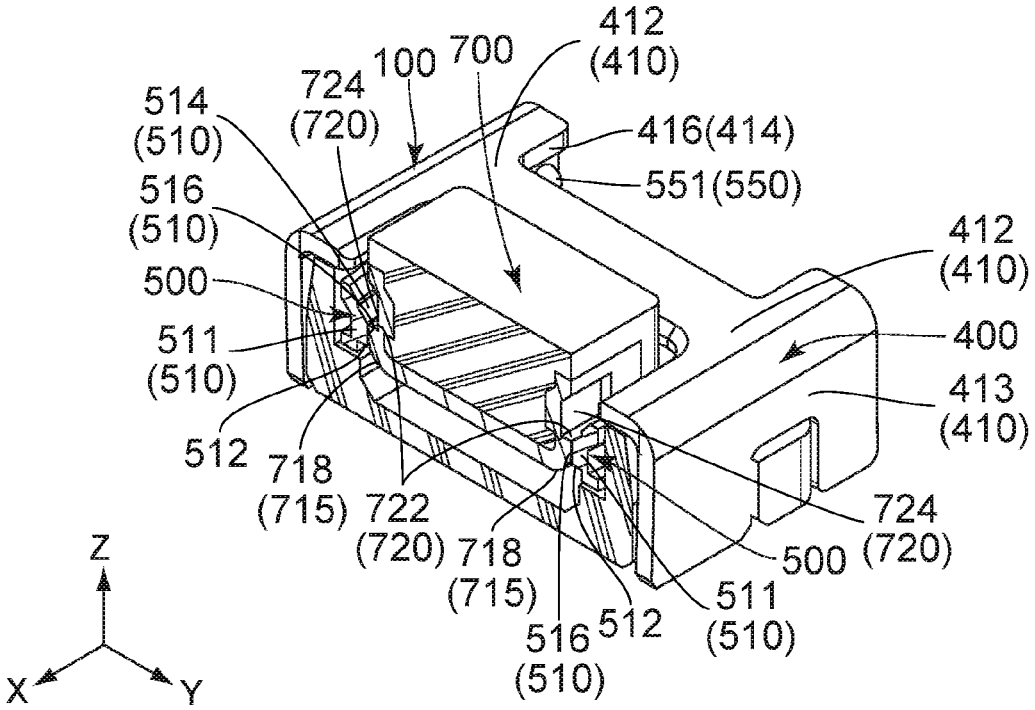
FIG. 19 is a cross-sectional, perspective view showing the connector and the mating connector of FIG. 18, taken along line F-F.

Referring to FIGS. 1, 8, 12 and 16 to 19, when the pressed portion 552 of the operation portion 550 is pressed outward in the second direction without contact of the first regulated portion 554 with the first regulating portion 580 under the mated state shown in FIGS. 16 and 17, the pressed portion 552 is moved outward in the second direction to reach a predetermined position shown in FIG. 19. In the predetermined embodiment, the pressing of the pressed portion 552 is achieved by using a jig. The jig may be inserted between the pressed portions 552 from above the connector 100, or may be inserted inward between the pressed portions 552 from an outside of the connector 100 in the first direction. When the pressed portion 552 is positioned at the predetermined position shown in FIG. 19, the lock portion 512 and the locked portion 722 corresponding to the lock portion 512 do not overlap with each other in the up-down direction while the second regulating portion 416 is positioned above the second regulated portion 562 in the up-down direction. Specifically, in each of the regulation mechanisms 500, the lock portion 512 and the locked portion 722 corresponding to the lock portion 512 do not overlap with each other in the up-down direction when the pressed portion 552 is moved outward in the second direction to reach the predetermined position without contact of the first regulated portion 554 with the first regulating portion 580 under the mated state. In addition, in each of the regulation mechanisms 500, the second regulated portion 562 is not brought into contact with the second regulating portion 416 even if the pressed portion 552 is moved outward in the second direction to the predetermined position under the mated state. More specifically, in each of the regulation mechanisms 500, when the pressed portion 552 is positioned at the predetermined position shown in FIG. 19, an upper end of the protruding portion 560 is positioned below the second regulating portion 416 in the up-down direction. As described above, the mated state of the connector 100 with the mating connector 700 of the present embodiment is released by the pressed portion 552 being moved outward in the second direction to the predetermined position under the mated state. When the mating connector 700 is pulled upward relative to the connector 100 in this state, the connector 100 and the mating connector 700 are in a state shown in each of FIGS. 18 and 19, so that the mating connector 700 is able to be removed from the connector 100.

Movements of the components of the additional member 400 upon the mating connector 700 being tried to be forcibly pulled off from the connector 100 under the mated state where the connector 100 is mated with the mating connector 700 are described in detail hereinafter.

Figure 20:
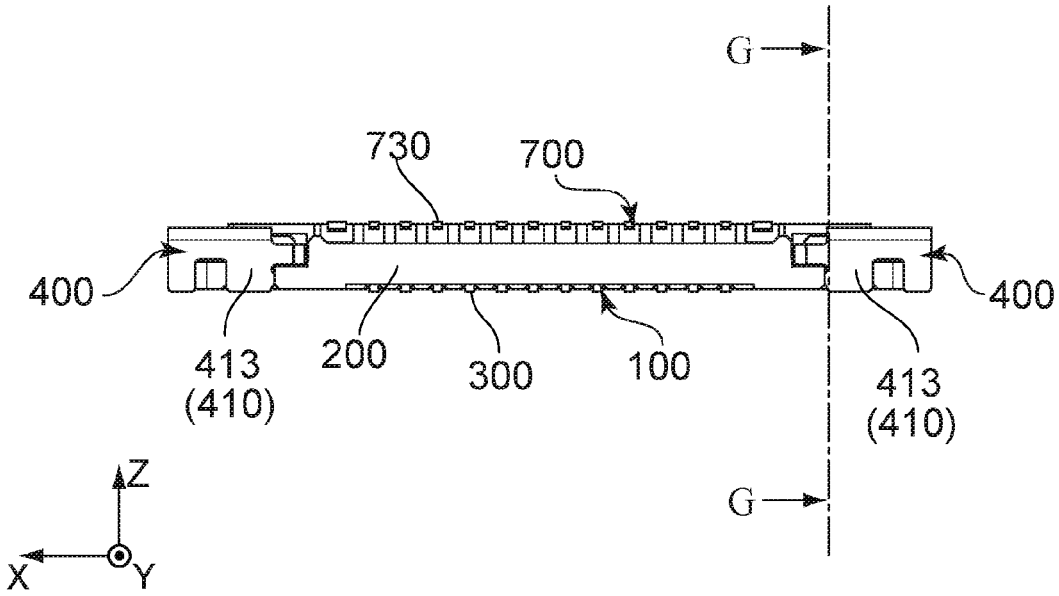
FIG. 20 is a side view showing a state where the mating connector is pulled upward under the mated state where the connector of FIG. 1 is mated with the mating connector of FIG. 12.
Figure 21:
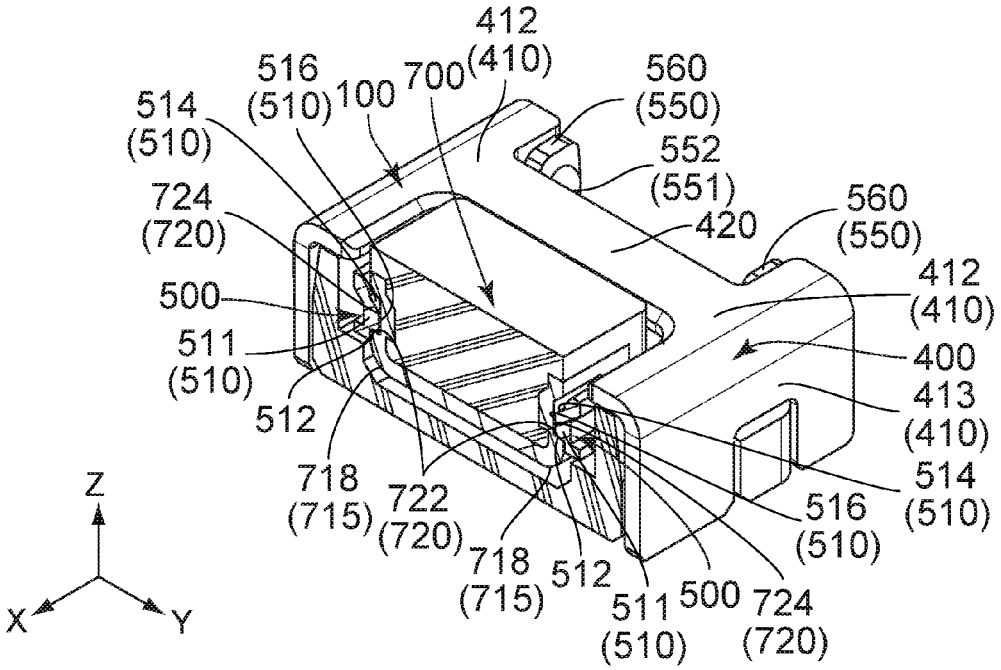
FIG. 21 is a cross-sectional, perspective view showing the connector and the mating connector of FIG. 20, taken along line G-G.
Figure 22:
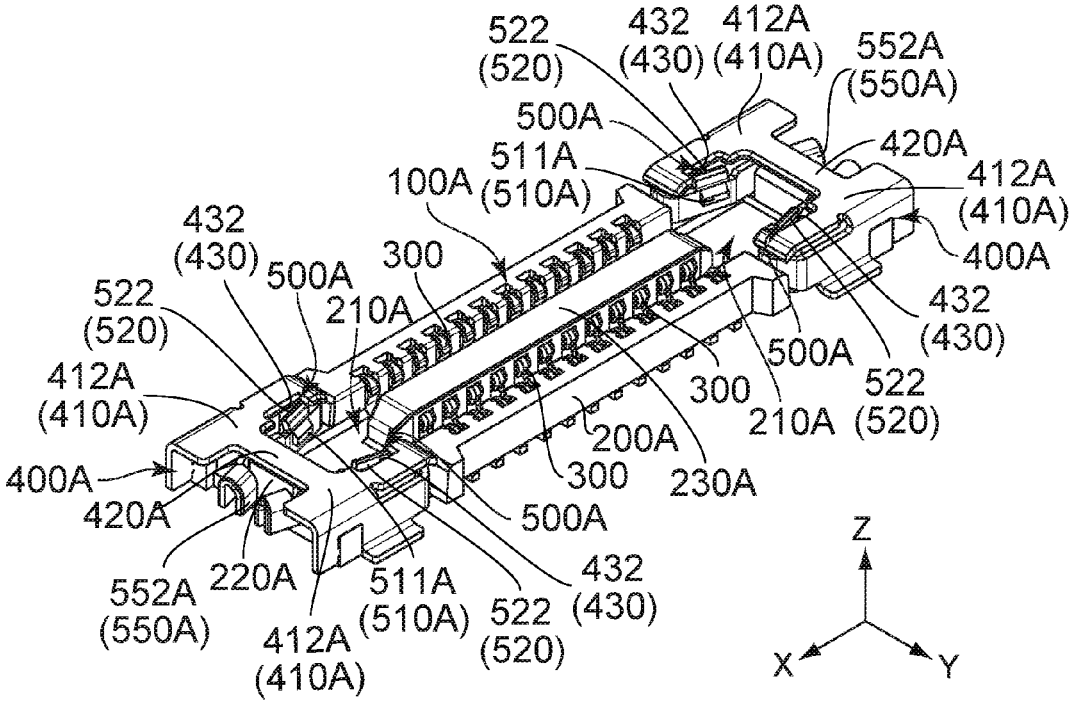
FIG. 22 is an upper perspective view showing a connector according to a second embodiment of the present invention.
Figure 23:
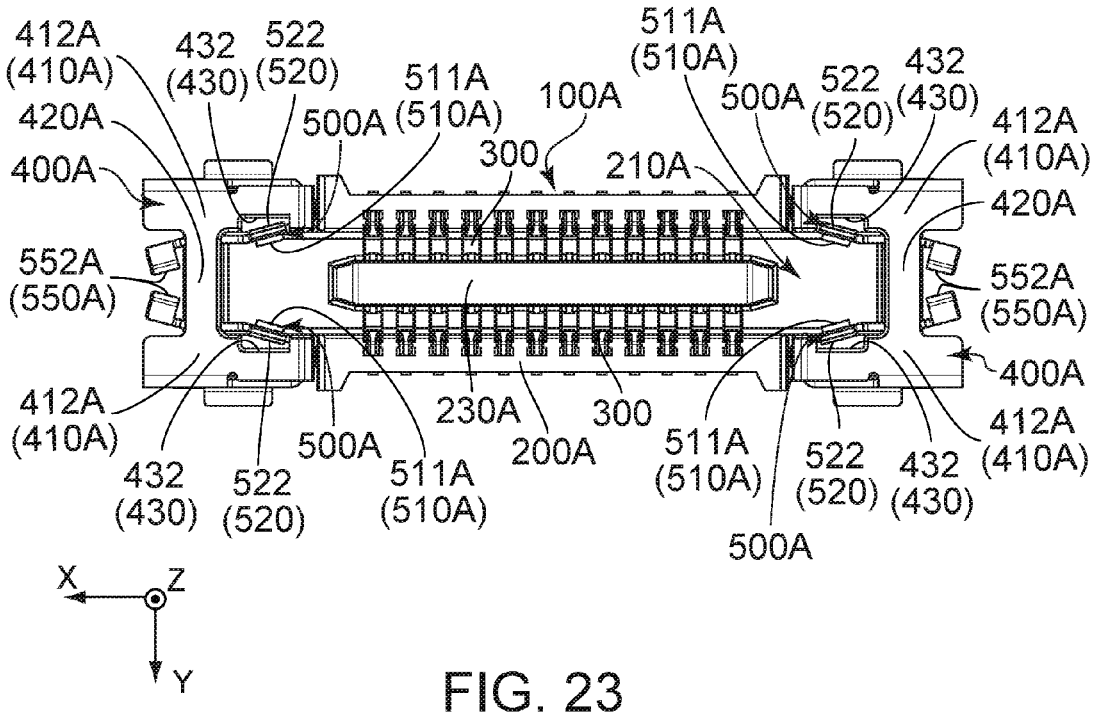
FIG. 23 is a top view showing the connector of FIG. 22.
Figure 24:
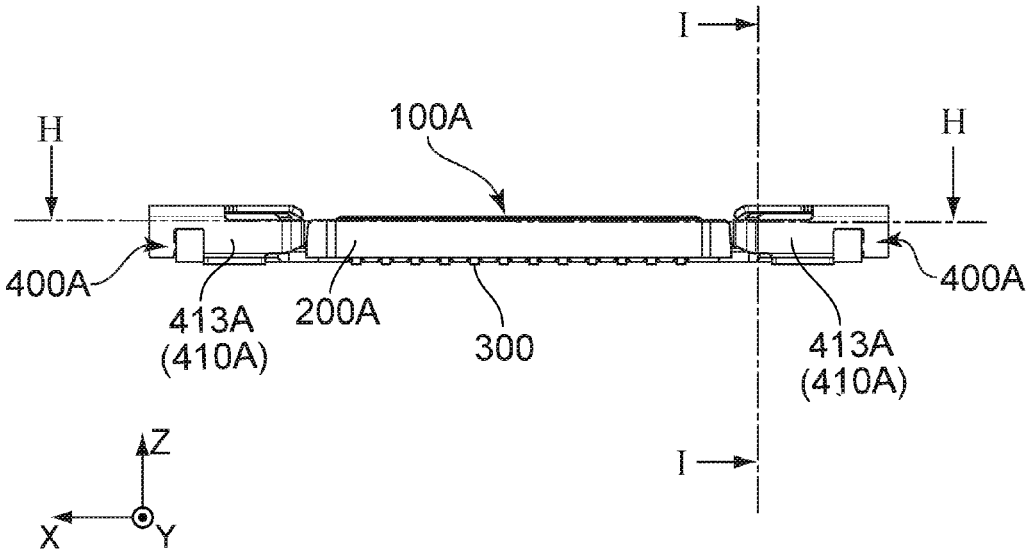
FIG. 24 is a side view showing the connector of FIG. 22.
Figure 25:
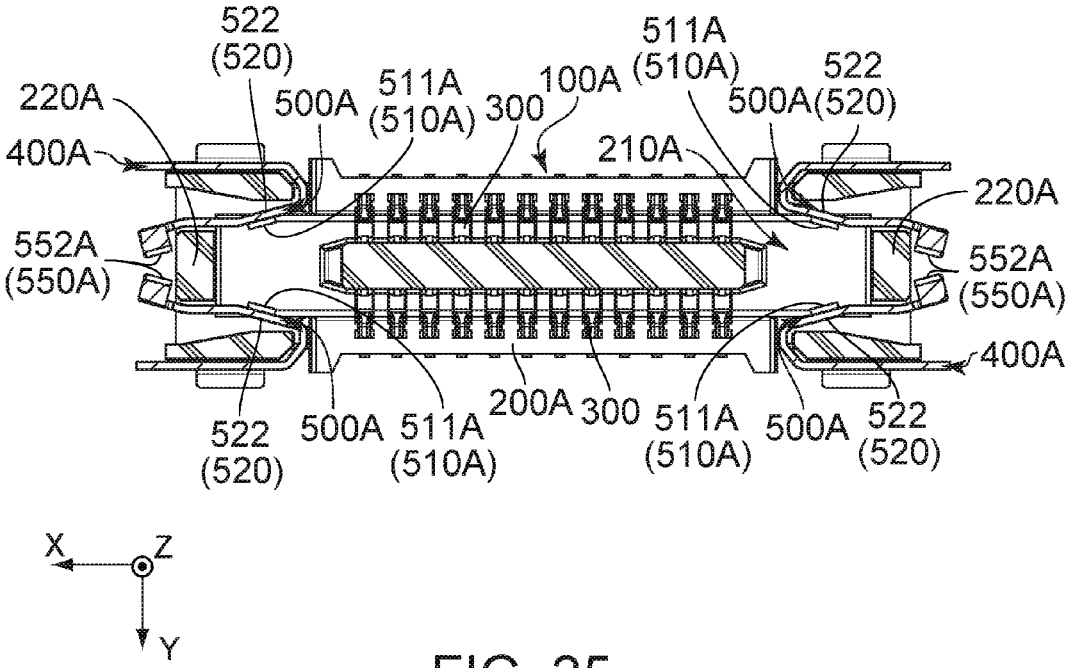
FIG. 25 is a cross-sectional view showing the connector of FIG. 24, taken along line H-H.

Referring to FIGS. 1, 8, 12, 16, 17, 20 and 21, when the mating connector 700 is tried to be forcibly pulled off from the connector 100 by being pulled upward in the up-down direction relative to the connector 100 under the mated state shown in each of FIGS. 16 and 17, the connector 100 and the mating connector 700 are in a state shown in each of FIGS. 20 and 21. In detail, when the mating connector 700 in the mated state is pulled upward relative to the connector 100, the locked portion 722 of the mating connector 700 is brought into contact with the lock portion 512, which corresponds to the locked portion 722, of the connector 100 in the up-down direction and then the first regulated portion 554 of the operation portion 550 is moved upward to abut against the first regulating portion 580. Accordingly, an upward movement of the lock portion 512 is regulated. Specifically, in each of the regulation mechanisms 500, an upward movement of the lock portion 512 is regulated when the first regulated portion 554 is moved upward in the up-down direction to abut against the first regulating portion 580. Meanwhile, a position of the second regulated portion 562 overlaps with a position of the second regulating portion 416 in the up-down direction. In other words, an upward end of the second regulated portion 562 is positioned above a lower end of the second regulating portion 416. When a further upward force is applied to the mating connector 700 under a state where the first regulated portion 554 abuts against the first regulating portion 580, the lock portion 512 receives an upward force. Although the upward force tries to move an upward end of the protruding portion 560 of the operation portion 550 outward in the second direction, the second regulated portion 562 is brought into contact with the second regulating portion 416 in the second direction, so that an outward movement of the lock portion 512 in the second direction is regulated. In other words, in each of the regulation mechanisms 500, the second regulating portion 416 is brought into contact with the second regulated portion 562 to regulate an outward movement of the lock portion 512 in the second direction when the lock portion 512 receives an upward force under the state where the first regulated portion 554 abuts against the first regulating portion 580. Accordingly, the mated state is maintained even if the mating connector 700 is pulled upward relative to the connector 100 under the mated state, so that the mating connector 700 is prevented from being forcibly pulled off from the connector 100. In addition, even if the mating connector 700 is pulled upward relative to the connector 100 under the mated state, a deformation of the spring portion 510 is prevented by the first regulating portion 580 and the second regulating portion 416, so that the resilience of the spring portion 510 is properly maintained. Thus, contact is properly made between the side surface 724 of each of the recesses 720 of the power terminals 715 of the mating connector 700 and the side surface 516 corresponding thereto of the protrusion 511 of the spring portion 510 of the additional member 400 of the connector 100, so that the electrical connections are properly made between the power terminals 715 of the mating connector 700 and the additional members 400 of the connector 100.

Second Embodiment

Referring to FIGS. 22 to 32, a connector 100A according to a second embodiment of the present invention is a modification of the connector 100 of the aforementioned first embodiment. The connector 100A is different from the connector 100 only in structures of additional members 400A and parts therearound. In FIGS. 22 to 32, components same as the components already described with FIGS. 1 to 11 are depicted with reference numerals same as those of the same components; explanation about those components will be omitted. For example, terminals 300 of the connector 100A are same as the terminals 300 of the aforementioned first embodiment. Likewise, a structural relation between a housing 200A and the terminals 300 of the connector 100A is same as a structural relation between the housing 200 and the terminals 300 of the aforementioned connector 100. As for directions and orientations in the present embodiment, expressions same as those of the first embodiment will be used hereinbelow.

As shown in FIGS. 22 to 26, the connector 100A of the present embodiment comprises a housing 200A, a plurality of terminals 300 and two additional members 400A.

As shown in FIGS. 22 to 26, the housing 200A of the present embodiment extends in the first direction. The housing 200A is made of insulator. The housing 200A is formed with a receiving portion 210A and an island-like portion 230A. The receiving portion 210A is recessed downward in the up-down direction. The island-like portion 230A is positioned inside the receiving portion 210A in a plane perpendicular to the up-down direction. The island-like portion 230A protrudes upward in the up-down direction.

The housing 200A has two deformation-preventing portions 220A which correspond to the two additional members 400A, respectively.

As shown in FIGS. 22 to 26, each of the additional members 400A of the present embodiment is held by the housing 200A. More specifically, the two additional members 400A are positioned at opposite ends, respectively, of the housing 200A in the first direction. Each of the additional members 400A faces the island-like portion 230A of the housing 200A in the first direction. Each of the additional members 400A of the present embodiment is made of metal.

As shown in FIGS. 22, 23 and 25 to 32, the additional member 400A has a symmetrical structure with respect to a plane, wherein the plane is defined by the first direction and the up-down direction while passing through a middle of the additional member 400A in the second direction.

As shown in FIGS. 27 to 32, each of the additional members 400A of the present embodiment comprises two regulation mechanisms 500A. In each of the additional members 400A, the two regulation mechanisms 500A are positioned away from each other in the second direction. The two regulation mechanisms 500A are arranged so as to be mirror-symmetric with each other to a plane, wherein the plane is defined by the first direction and the up-down direction while passing through the middle of the additional member 400A in the second direction. Each of the two regulation mechanisms 500A is independently movable. Each of the regulation mechanisms 500A comprises a spring portion 510A, an operation portion 550A, a first regulating portion 580A and a second regulating portion 432.

As shown in FIGS. 27 to 32, in each of the regulation mechanisms 500A, the spring portion 510A of the present embodiment has a U-shape or a J-shape in a plane perpendicular to the up-down direction. The spring portion 510A is resiliently deformable. In each of the regulation mechanisms 500A, the spring portion 510A of the present embodiment has a bent portion 517A, a flat plate portion 518A, a protrusion 511A and a protruding portion 520.

As shown in FIGS. 27 to 32, the bent portion 517A has a C-shape when viewed along the up-down direction. The flat plate portion 518A has a plate-like shape extending substantially in the first direction. A size of the flat plate portion 518A in the second direction is smaller than a size of the flat plate portion 518A in the up-down direction.

As shown in FIGS. 27 to 32, the protrusion 511A of the present embodiment protrudes inward in the second direction. More specifically, the protrusion 511A protrudes inward in the second direction from an inner surface of the flat plate portion 518A of the spring portion 510A. The protrusion 511A has a lower surface 512A and a slope surface 514A in the up-down direction. The lower surface 512A faces downward in the up-down direction. More specifically, the lower surface 512A is a plane perpendicular to the up-down direction. The slope surface 514A intersects with both the up-down direction and the second direction. In addition, the protrusion 511A has a side surface 516A intersecting with the second direction. The side surface 516A faces inward in the second direction. The side surface 516A is positioned between the slope surface 514A and the lower surface 512A in the up-down direction. The lower surface 512A of the protrusion 511A functions as a lock portion 512A. In other words, the spring portion 510A has the lock portion 512A. The lock portion 512A is positioned in the receiving portion 210A of the housing 200A. The lock portion 512A faces downward in the up-down direction. The lock portions 512A correspond to the locked portions 722, respectively, of the mating connector 700.

As shown in FIGS. 27 to 32, the protruding portion 520 of the present embodiment protrudes upward in the up-down direction. The protruding portion 520 has a side surface 522 in the second direction. The side surface 522 is an outer surface of the protruding portion 520 in the second direction. The side surface 522 of the protruding portion 520 functions as a second regulated portion 522. Specifically, in each of the regulation mechanisms 500A, the spring portion 510A is provided with the second regulated portion 522. In each of the regulation mechanisms 500A, the second regulated portion 522 is positioned above the lock portion 512A in the up-down direction.

As shown in FIGS. 27 to 32, in each of the regulation mechanisms 500A, the operation portion 550A has a plate portion 556A and a folded portion 551A. In each of the regulation mechanisms 500A, the operation portion 550A of the present embodiment extends outward in the first direction from the spring portion 510A. More specifically, the plate portion 556A of the operation portion 550A of the present embodiment extends outward in the first direction from an outward end of the flat plate portion 518A of the spring portion 510A. The folded portion 551A is positioned in the vicinity of an outward end of the plate portion 556A in the first direction. A part of an upper end of the plate portion 556A in the up-down direction functions as a first regulated portion 554A. An inner end of the folded portion 551A in the second direction functions as a pressed portion 552A. In other words, the operation portion 550A has the pressed portion 552A and the first regulated portion 554A. The pressed portion 552A is positioned outward in the first direction beyond the receiving portion 210A. In each of the regulation mechanisms 500A, the lock portion 512A of the spring portion 510A is moved outward in the second direction when the pressed portion 552A is moved outward in the second direction. In each of the regulation mechanisms 500A, the first regulated portion 554A is positioned between the lock portion 512A of the spring portion 510A and the pressed portion 552A in the first direction.

As shown in FIGS. 27 to 32, each of the additional members 400A of the present embodiment has two base portions 410A and a beam portion 420A.

As shown in FIGS. 27 to 32, each of the base portions 410A of the present embodiment has an upper plate portion 412A and a side plate portion 413A. The upper plate portion 412A has a plate-like shape intersecting with the up-down direction. The side plate portion 413A extends upward in the up-down direction. An upper end of the side plate portion 413A in the up-down direction is connected with an outer end of the upper plate portion 412A in the second direction. The two base portions 410A belong to the two regulation mechanisms 500A, respectively. In each of the regulation mechanisms 500A, the spring portion 510A extends from the base portion 410A. More specifically, the bent portion 517A of the spring portion 510A extends from an inner end of the side plate portion 413A of the base portion 410A in the first direction.

As shown in FIGS. 27 to 32, in each of the regulation mechanisms 500A, the second regulating portion 432 is provided on the base portion 410A. Specifically, in each of the regulation mechanisms 500A, the upper plate portion 412A of the base portion 410A is formed with an accommodating portion 430. The accommodating portion 430 is a recess which is recessed outward in the second direction. The accommodating portion 430 has an inner edge 432 facing the second direction. The inner edge 432 functions as the second regulating portion 432. In other words, each of the additional members 400A has the two accommodating portions 430 which belong to the two regulation mechanisms 500A, respectively.

As shown in FIGS. 27 to 32, the beam portion 420A of the present embodiment has a plate-like shape intersecting with the up-down direction. More specifically, the beam portion 420A has a plate-like shape perpendicular to the up-down direction. Specifically, the beam portion 420A has an upper surface and a lower surface in the up-down direction. The beam portion 420A couples the two base portions 410A with each other in the second direction. More specifically, the beam portion 420A couples the upper plate portions 412A of the two base portions 410A with each other. The first regulating portion 580A of each of the regulation mechanisms 500A is formed as a part of the beam portion 420A. More specifically, the first regulating portion 580A is a part of the lower surface of the beam portion 420A.

Figure 26:
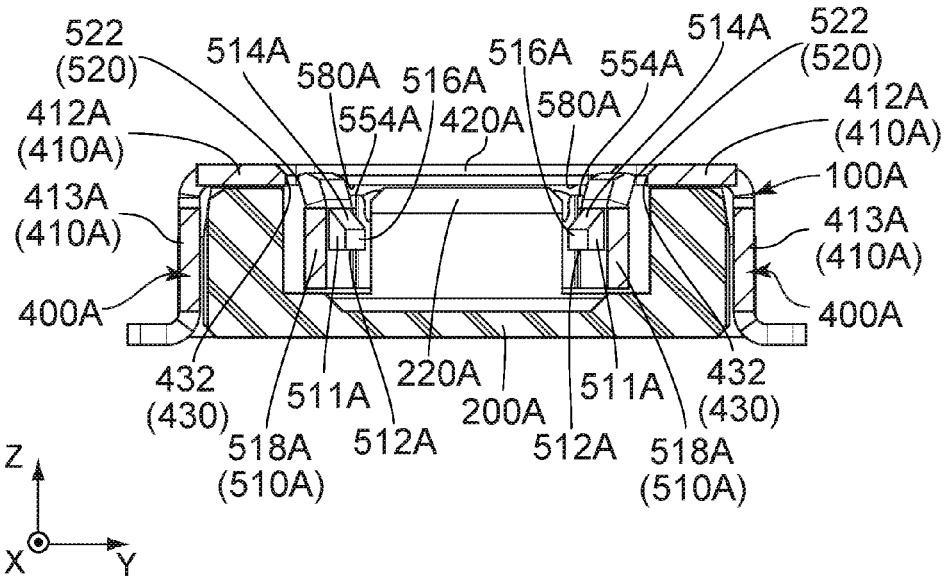
FIG. 26 is a cross-sectional view showing the connector of FIG. 24, taken along line I-I.
Figure 27:
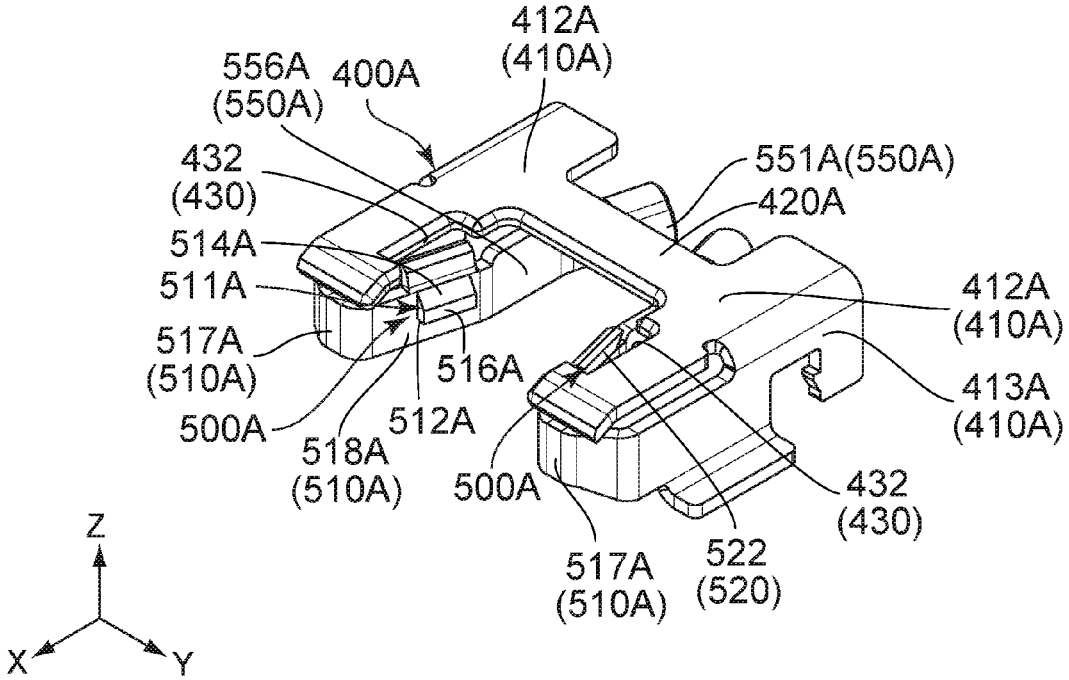
FIG. 27 is a front, perspective view showing one of additional members which are included in the connector of FIG. 22.
Figure 28:
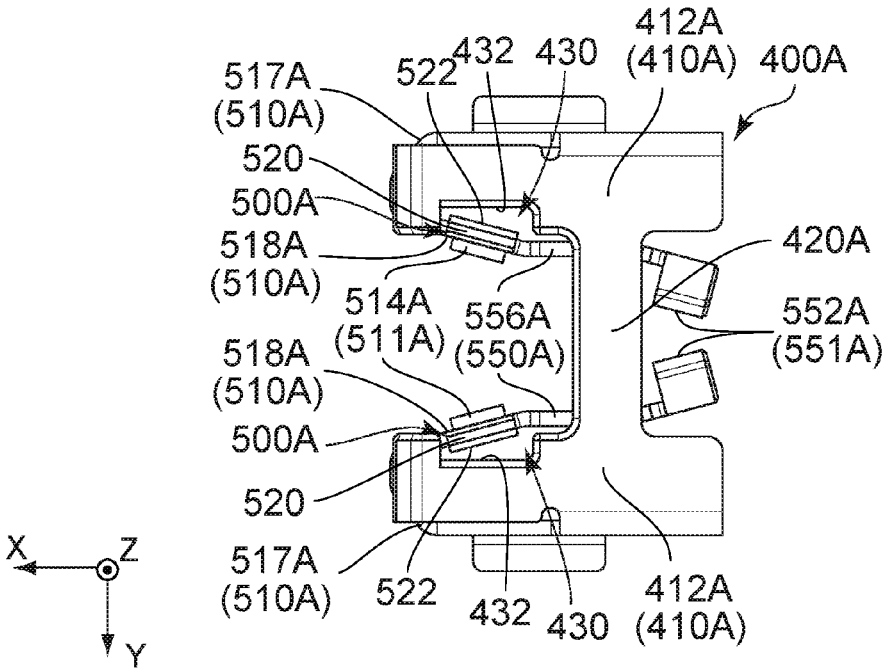
FIG. 28 is a top view showing the additional member of FIG. 27.
Figure 29:
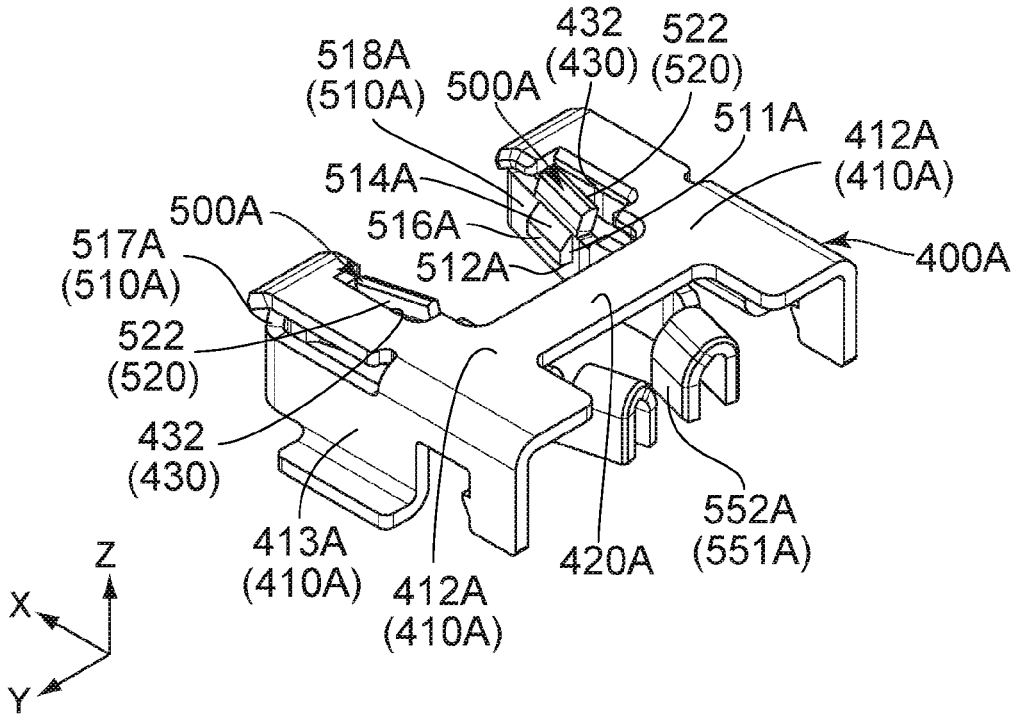
FIG. 29 is a rear, perspective view showing the additional member of FIG. 27.
Figure 30:
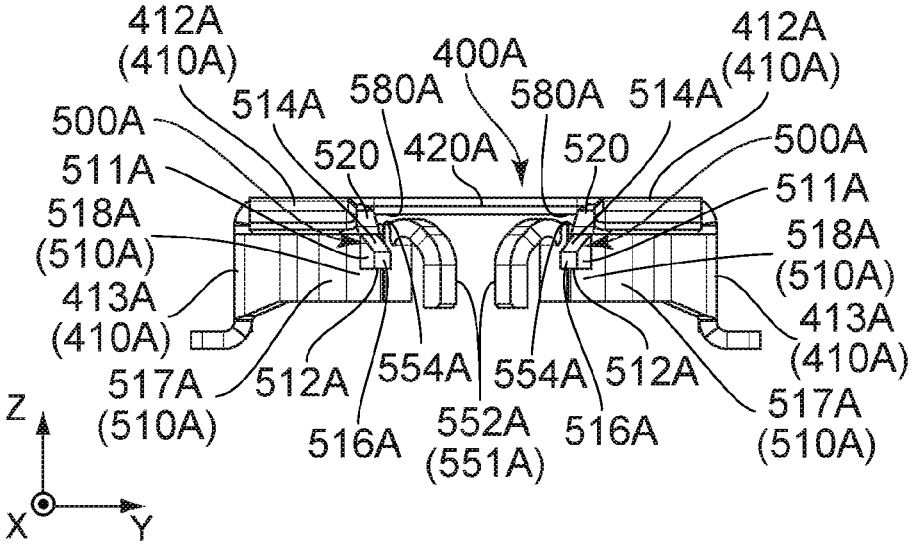
FIG. 30 is a front view showing the additional member of FIG. 27.
Figure 31:
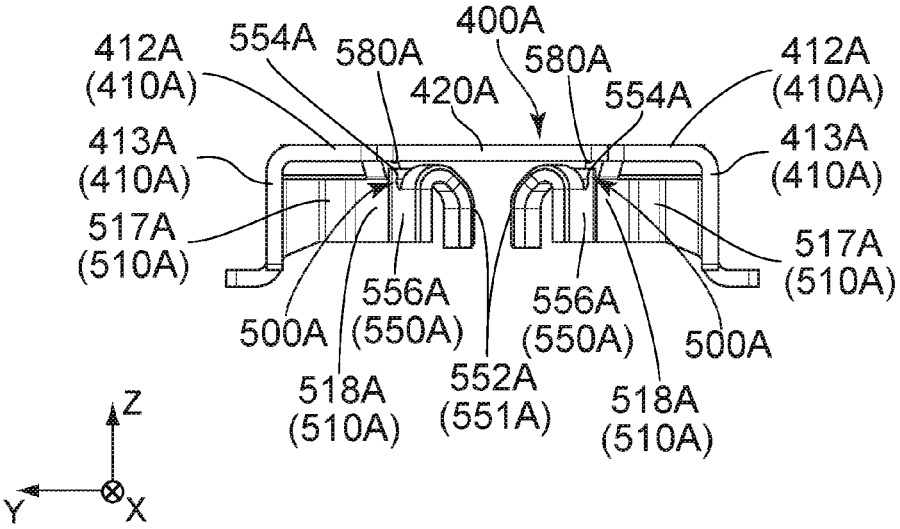
FIG. 31 is a rear view showing the additional member of FIG. 27.
Figure 32:
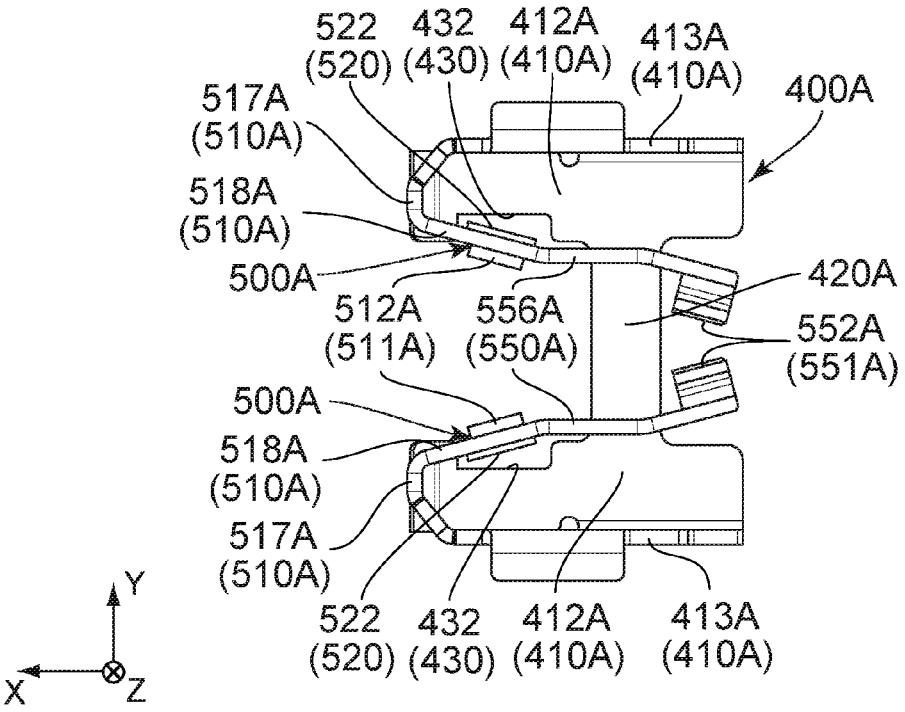
FIG. 32 is a bottom view showing the additional member of FIG. 27.
Figure 33:
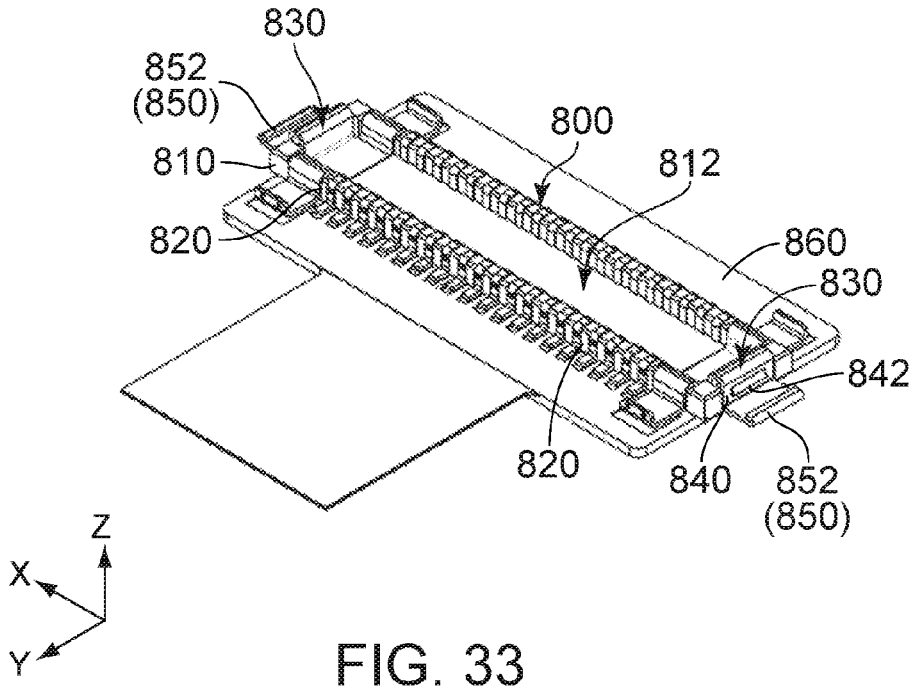
FIG. 33 PRIOR ART
FIG. 33 is an upper perspective view showing a connector of Patent Document 1.
Figure 34:
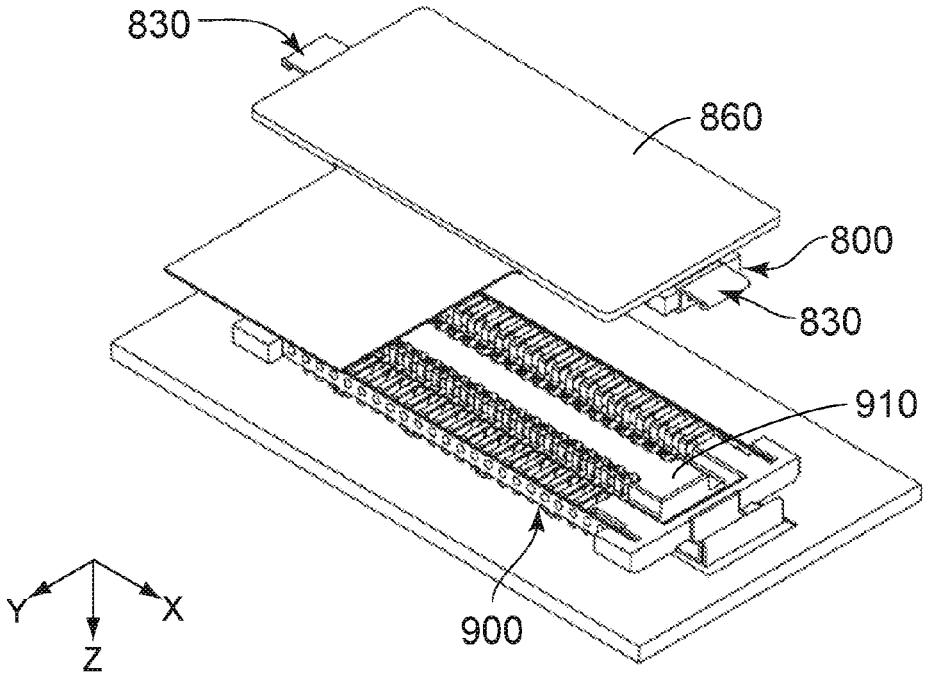
FIG. 34 PRIOR ART
FIG. 34 is a perspective view showing the connector of FIG. 33 and a mating connector of Patent Document 1, wherein the connector is not mated with the mating connector.
Figure 35:
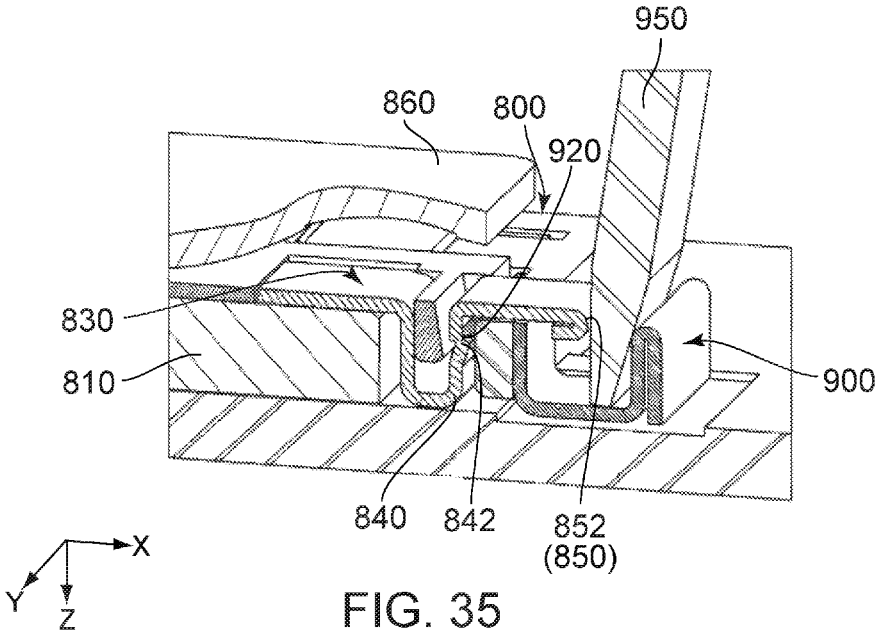
FIG. 35 PRIOR ART
FIG. 35 is a partial, cross-sectional view showing the connector and the mating connector of FIG. 34, wherein the connector is mated with the mating connector.

As shown in FIGS. 26, 30 and 31, in each of the regulation mechanisms 500A, the first regulating portion 580A is positioned above the first regulated portion 554A in the up-down direction.

As shown in FIG. 26, each of the deformation-preventing portions 220A is positioned below the beam portion 420A of the additional member 400A corresponding thereto in the up-down direction. The deformation-preventing portion 220A is a portion which prevents a deformation of the beam portion 420A by being brought into contact with the beam portion 420A when the beam portion 420A of the additional member 400A is pressed downward in the up-down direction. More specifically, an upper surface of the deformation-preventing portion 220A prevents a deformation of the beam portion 420A by being brought into contact with the lower surface of the beam portion 420A when the upper surface of the beam portion 420A is pressed downward.

As understood from FIGS. 26 to 32, in each of the regulation mechanisms 500A, the second regulating portion 432 is positioned inward of the first regulating portion 580A in the first direction. In each of the regulation mechanisms 500A, the second regulated portion 522 is positioned at a position same as a position of the second regulating portion 432 in the up-down direction when no upward force is applied to the lock portion 512A.

An operation of mating the connector 100A with the mating connector 700 is described in detail hereinafter.

Referring to FIGS. 1, 12, 16 to 19 and 22, the connector 100A and the mating connector 700 of the present embodiment are arranged so that the slope surfaces 514A of the protrusions 511A of the connector 100A face the corner portions 718, respectively, of the power terminals 715 of the mating connector 700 in the up-down direction, and the mating connector 700 is moved downward relative to the connector 100A along the up-down direction. Then, the slope surface 514A of each of the protrusions 511A of the connector 100A abuts against the corner portion 718 corresponding thereto of the power terminal 715 of the mating connector 700 and each of the spring portions 510A is resiliently deformed, so that each of the protrusions 511A is moved outward in the second direction. At that time, the protruding portion 520 is accommodated in the accommodating portion 430, while a deformation of the spring portion 510A is not prevented because the second regulated portion 522 is not brought into contact with the second regulating portion 432. In this state, when the mating connector 700 is further moved downward relative to the connector 100A so that the lock portion 512A and the locked portion 722A corresponding thereto are positioned at the same position as each other in the up-down direction, the protrusions 511A of the connector 100A are accommodated in the recesses 720, respectively, of the mating connector 700. In other words, the connector 100A and the mating connector 700 are in a mated state where the connector 100A and the mating connector 700 are mated with each other.

Referring to FIGS. 1, 12, 16, 17 and 22, under the mated state where the connector 100A and the mating connector 700 of the present embodiment are mated with each other, each of the locked portions 722 faces upward in the up-down direction while each of the locked portions 722 of the mating connector 700 at least overlaps with the lock portion 512A corresponding to the locked portion 722 in the up-down direction. In addition, under the mated state, the receiving portion 210A of the housing 200A of the connector 100A receives the received portion 710 of the mating connector 700 while the island-like portion 230A of the housing 200A of the connector 100A is accommodated in the island-like portion accommodating portion 740 of the mating housing 705 of the mating connector 700. Also, under the mated state, the terminals 300 of the connector 100A are connected with the mating terminals 730, respectively, of the mating connector 700. Furthermore, under the mated state, the side surfaces 724 of the recesses 720 of the power terminals 715 of the mating connector 700 are brought into contact with the side surfaces 516A, respectively, of the protrusions 511A of the spring portions 510A of the additional members 400A of the connector 100A, so that electrical connections are made between the power terminals 715 of the mating connector 700 and the additional members 400A of the connector 100A.

An operation of releasing the mated state of the connector 100A with the mating connector 700 is described in detail hereinafter.

Referring to FIGS. 1, 12, 16 to 19 and 22, when the pressed portion 552A of the operation portion 550A is pressed, for example, by using a jig, outward in the second direction without contact of the first regulated portion 554A with the first regulating portion 580A under the mated state where the connector 100A is mated with the mating connector 700, the pressed portion 552A is moved outward in the second direction to reach a predetermined position (not shown). When the pressed portion 552A is positioned at the predetermined position, the lock portion 512A and the locked portion 722 corresponding to the lock portion 512A do not overlap with each other in the up-down direction while the second regulated portion 522 is positioned away from the second regulating portion 432 in the second direction. Specifically, in each of the regulation mechanisms 500A, the lock portion 512A and the locked portion 722 corresponding to the lock portion 512A do not overlap with each other in the up-down direction when the pressed portion 552A is moved outward in the second direction to reach the predetermined position without contact of the first regulated portion 554A with the first regulating portion 580A under the mated state. In addition, in each of the regulation mechanisms 500A, the second regulated portion 522 is not brought into contact with the second regulating portion 432 even if the pressed portion 552A is moved outward in the second direction to the predetermined position under the mated state. Also, in each of the regulation mechanisms 500A, the second regulated portion 522 is accommodated in the accommodating portion 430 when the pressed portion 552A is moved outward in the second direction to the predetermined position under the mated state. As described above, the mated state of the connector 100A with the mating connector 700 of the present embodiment is released by the pressed portion 552A being moved outward in the second direction to the predetermined position under the mated state. When the mating connector 700 is pulled upward relative to the connector 100A in this state, the mating connector 700 is able to be removed from the connector 100A.

Movements of the components of the additional member 400A upon the mating connector 700 being tried to be forcibly pulled off from the connector 100A under the mated state where the connector 100A is mated with the mating connector 700 are described in detail hereinafter.

Referring to FIGS. 1, 12, 16, 17 and 20 to 22, when the mating connector 700 is tried to be forcibly pulled off from the connector 100A by being pulled upward in the up-down direction relative to the connector 100A under the mated state, the connector 100A and the mating connector 700 are in a state similar to the state shown in each of FIGS. 20 and 21. In detail, when the mating connector 700 in the mated state is pulled upward relative to the connector 100A, the locked portion 722 of the mating connector 700 is brought into contact with the lock portion 512A, which corresponds to the locked portion 722, of the connector 100A in the up-down direction and then the first regulated portion 554A of the operation portion 550A is moved upward to abut against the first regulating portion 580A. Accordingly, an upward movement of the lock portion 512A is regulated. Specifically, in each of the regulation mechanisms 500A, an upward movement of the lock portion 512A is regulated when the first regulated portion 554A is moved upward in the up-down direction to abut against the first regulating portion 580A. When a further upward force is applied to the mating connector 700 under a state where the first regulated portion 554A abuts against the first regulating portion 580A, the lock portion 512A receives an upward force. The upward force twists the spring portion 510A so that an upward end of the protruding portion 520 of the spring portion 510A is moved outward in the second direction, and the second regulated portion 522 is brought into contact with the second regulating portion 432 in the second direction so that an outward movement of the lock portion 512A in the second direction is regulated. In other words, in each of the regulation mechanisms 500A, the second regulating portion 432 is brought into contact with the second regulated portion 522 to regulate an outward movement of the lock portion 512A in the second direction when the lock portion 512A receives an upward force under the state where the first regulated portion 554A abuts against the first regulating portion 580A. Accordingly, the mated state is maintained even if the mating connector 700 is pulled upward relative to the connector 100A under the mated state, so that the mating connector 700 is prevented from being forcibly pulled off from the connector 100A. In addition, even if the mating connector 700 is pulled upward relative to the connector 100A under the mated state, a deformation of the spring portion 510A is prevented by the first regulating portion 580A and the second regulating portion 432, so that the resilience of the spring portion 510A is properly maintained. Thus, contact is properly made between the side surface 724 of each of the recesses 720 of the power terminals 715 of the mating connector 700 and the side surface 516A corresponding thereto of the protrusion 511A of the spring portion 510A of the additional member 400A of the connector 100A, so that the electrical connections are properly made between the power terminals 715 of the mating connector 700 and the additional members 400A of the connector 100A.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mountable on an object in an up-down direction and mateable with a mating connector along the up-down direction, wherein:

the mating connector comprises a received portion and four locked portions;

each of the locked portions is provided on the received portion;

under a mated state where the connector is mated with the mating connector, each of the locked portions faces upward in the up-down direction;

the connector comprises a housing, a plurality of terminals and two additional members;

each of the terminals is held by the housing;

each of the additional members is held by the housing;

the housing is formed with a receiving portion;

under the mated state, the receiving portion receives the received portion;

the two additional members are positioned at opposite ends, respectively, of the housing in a first direction perpendicular to the up-down direction;

each of the additional members comprises two regulation mechanisms;

in each of the additional members, the two regulation mechanisms are positioned away from each other in a second direction perpendicular to both the up-down direction and the first direction;

each of the regulation mechanisms comprises a spring portion, an operation portion, a first regulating portion, and a second regulating portion;

in each of the regulation mechanisms, the spring portion is resiliently deformable and has a lock portion;

in each of the regulation mechanisms, the lock portion is positioned in the receiving portion and faces downward in the up-down direction;

the lock portions correspond to the locked portions, respectively;

under the mated state, each of the locked portions at least overlaps with the lock portion corresponding to the locked portion in the up-down direction;

in each of the regulation mechanisms, the operation portion extends outward in the first direction from the spring portion;

in each of the regulation mechanisms, the operation portion has a pressed portion and a first regulated portion;

in each of the regulation mechanisms, the pressed portion is positioned outward in the first direction beyond the receiving portion;

in each of the regulation mechanisms, one of the spring portion and the operation portion is provided with a second regulated portion;

in each of the regulation mechanisms, the lock portion is moved outward in the second direction when the pressed portion is moved outward in the second direction;

in each of the regulation mechanisms, the first regulated portion is positioned between the lock portion and the pressed portion in the first direction;

in each of the regulation mechanisms, the first regulating portion is positioned above the first regulated portion in the up-down direction;

in each of the regulation mechanisms, an upward movement of the lock portion is regulated when the first regulated portion is moved upward in the up-down direction to abut against the first regulating portion; and in each of the regulation mechanisms, the second regulating portion is brought into contact with the second regulated portion to regulate an outward movement of the lock portion in the second direction when the lock portion receives an upward force under a state where the first regulated portion abuts against the first regulating portion.

2. The connector as recited in claim 1, wherein, in each of the regulation mechanisms, the spring portion has a U-shape or a J-shape in a plane perpendicular to the up-down direction.

3. The connector as recited in claim 1, wherein:

in each of the regulation mechanisms, the spring portion has a protrusion protruding inward in the second direction;

in each of the regulation mechanisms, the protrusion has a lower surface in the up-down direction;

in each of the regulation mechanisms, the lower surface of the protrusion functions as the lock portion;

the mating connector comprises four recesses;

each of the recesses has a lower surface in the up-down direction; and the lower surface of each of the recesses functions as the locked portion.

4. The connector as recited in claim 1, wherein:

each of the additional members has two base portions and a beam portion;

the two base portions belong to the two regulation mechanisms, respectively;

in each of the regulation mechanisms, the spring portion extends from the base portion;

in each of the regulation mechanisms, the second regulating portion is provided on the base portion;

the beam portion couples the two base portions with each other in the second direction; and the first regulating portion of each of the regulation mechanisms is formed as a part of the beam portion.

5. The connector as recited in claim 4, wherein:

the housing has two deformation-preventing portions which correspond to the two additional members, respectively; and each of the deformation-preventing portions is positioned below the beam portion of the additional member corresponding thereto in the up-down direction, and each of the deformation-preventing portions is brought into contact with the beam portion to prevent a deformation of the beam portion when the beam portion is pressed downward in the up-down direction.

6. The connector as recited in claim 4, wherein:

the beam portion has a plate-like shape intersecting with the up-down direction;

each of the base portions has an upper plate portion;

the upper plate portion has a plate-like shape intersecting with the up-down direction;

the upper plate portion has an edge facing the second direction;

the beam portion couples the upper plate portions of the two base portions with each other; and in each of the regulation mechanisms, the second regulating portion is provided on the edge of the upper plate portion of the base portion.

7. The connector as recited in claim 1, wherein:

in each of the regulation mechanisms, the lock portion and the locked portion corresponding to the lock portion do not overlap with each other in the up-down direction when the pressed portion is moved outward in the second direction to reach a predetermined position without contact of the first regulated portion with the first regulating portion under the mated state; and in each of the regulation mechanisms, the second regulated portion is not brought into contact with the second regulating portion even if the pressed portion is moved outward in the second direction to the predetermined position under the mated state.

8. The connector as recited in claim 1, wherein, in each of the regulation mechanisms, the second regulating portion is positioned outward of the first regulating portion in the first direction.

9. The connector as recited in claim 8, wherein, in each of the regulation mechanisms, the second regulated portion is positioned at a position different from a position of the second regulating portion in the up-down direction when no upward force is applied to the lock portion.

10. The connector as recited in claim 8, wherein, in each of the regulation mechanisms, the operation portion has a protruding portion which protrudes upward in the up-down direction, the protruding portion having a side surface in the second direction, the side surface of the protruding portion functioning as the second regulated portion.

11. The connector as recited in claim 1, wherein, in each of the regulation mechanisms, the second regulating portion is positioned inward of the first regulating portion in the first direction.

12. The connector as recited in claim 11, wherein:

in each of the regulation mechanisms, the lock portion and the locked portion corresponding to the lock portion do not overlap with each other in the up-down direction when the pressed portion is moved outward in the second direction to reach a predetermined position without contact of the first regulated portion with the first regulating portion under the mated state; and in each of the regulation mechanisms, the second regulated portion is not brought into contact with the second regulating portion even if the pressed portion is moved outward in the second direction to the predetermined position under the mated state.

13. The connector recited in claim 12, wherein:

each of the additional members has two accommodating portions which belong to the two regulation mechanisms, respectively;

in each of the regulation mechanisms, the accommodating portion has an inner edge facing the second direction;

the inner edge functions as the second regulating portion; and in each of the regulation mechanisms, the second regulated portion is accommodated in the accommodating portion when the pressed portion is moved outward in the second direction to the predetermined position under the mated state.

14. The connector as recited in claim 13, wherein, in each of the regulation mechanisms, the second regulated portion is positioned at a position same as a position of the second regulating portion in the up-down direction when no upward force is applied to the lock portion.

15. The connector as recited in claim 14, wherein, in each of the regulation mechanisms, the second regulated portion is positioned above the lock portion in the up-down direction.

16. The connector as recited in claim 11, wherein, in each of the regulation mechanisms, the spring portion has a protruding portion which protrudes upward in the up-down direction, the protruding portion having a side surface in the second direction, the side surface of the protruding portion functioning as the second regulated portion.

* * * * *